US011616307B2

(12) United States Patent
Sledkov

(10) Patent No.: US 11,616,307 B2
(45) Date of Patent: Mar. 28, 2023

(54) ARTIFICIAL DIELECTRIC MATERIAL AND FOCUSING LENSES MADE OF IT

(71) Applicant: Vasant Limited, Wellington (NZ)

(72) Inventor: Victor Aleksandrovich Sledkov, Wellington (NZ)

(73) Assignee: VASANT LIMITED, Wellington (NZ)

( * ) Notice: Subject to any disclaimer, the term of this patent is extended or adjusted under 35 U.S.C. 154(b) by 0 days.

(21) Appl. No.: 17/754,443

(22) PCT Filed: Oct. 22, 2021

(86) PCT No.: PCT/NZ2021/050182
§ 371 (c)(1),
(2) Date: Apr. 1, 2022

(87) PCT Pub. No.: WO2022/093042
PCT Pub. Date: May 5, 2022

(65) Prior Publication Data
US 2022/0416433 A1 Dec. 29, 2022

(30) Foreign Application Priority Data
Oct. 27, 2020 (NZ) ..... 769421

(51) Int. Cl.
*H01Q 15/02* (2006.01)
*H01Q 15/10* (2006.01)

(52) U.S. Cl.
CPC ..... *H01Q 15/10* (2013.01)

(58) Field of Classification Search
CPC ..... H01Q 15/02; H01Q 15/04; H01Q 15/08; H01Q 15/10; H01Q 1/38; H01Q 19/06; H01Q 19/09
See application file for complete search history.

(56) References Cited

U.S. PATENT DOCUMENTS 7,205,941 B2 * 4/2007 Wang ..... H01Q 3/44 343/909
8,518,537 B2 8/2013 Matitsine
9,819,094 B2 11/2017 Matitsine et al.
(Continued)

FOREIGN PATENT DOCUMENTS

NZ 752904 B2 3/2021

OTHER PUBLICATIONS

International Preliminary Report on Patentability in PCT/NZ2021/050182, 20 pages, dated Mar. 1, 2022.
(Continued)

*Primary Examiner* — Tho G Phan
(74) *Attorney, Agent, or Firm* — Heslin Rothenberg Farley & Mesiti P.C.

(57) ABSTRACT

Provided herein is an artificial dielectric material comprising a plurality of layered sheets of a dielectric material and a plurality of conductive elements disposed in holes made in the sheets of the dielectric material, wherein each conductive element is substantially tubular and comprises a slit along its length so as to provide a gap between two longitudinal edges. Also provided are lenses comprising the artificial dielectric materials and methods for manufacture of such materials. The artificial dielectric materials and lenses may provide desirable dielectric and radio wave focusing properties and manufacturing advantages.

33 Claims, 16 Drawing Sheets

(56) References Cited

U.S. PATENT DOCUMENTS

| | | | | |
|---|---|---|---|---|
| 10,971,823 | B1 * | 4/2021 | Sledkov | H01Q 15/08 |
| 11,264,726 | B2 * | 3/2022 | Zimmerman | H01Q 21/061 |
| 11,336,023 | B2 * | 5/2022 | Matitsine | H01Q 3/08 |
| 11,527,835 | B2 * | 12/2022 | Radelet | H01Q 15/08 |
| 2008/0088524 | A1 | 4/2008 | Wang et al. | |
| 2010/0066639 | A1 | 3/2010 | Ngyuen et al. | |
| 2018/0034160 | A1 | 2/2018 | Matitsine | |

OTHER PUBLICATIONS

International Search Report and Written Opinion in PCT/NZ2021/050182, 9 pages, dated Jan. 12, 2022.

* cited by examiner

ARTIFICIAL DIELECTRIC MATERIAL AND FOCUSING LENSES MADE OF IT

CROSS-REFERENCE TO RELATED APPLICATIONS

The present invention application is a U.S. National Phase filing under 35 U.S.C. 0 371 of International Application No. PCT/NZ2021/050182, filed Oct. 21, 2021, which claims priority from New Zealand patent application 769421, filed Oct. 27, 2020. The entire contents of each of these prior applications are hereby incorporated herein by reference.

FIELD OF THE INVENTION

The present invention relates to artificial dielectric materials comprising conductive elements and focusing lenses made thereof for electromagnetic waves.

BACKGROUND

The modern mobile communication market needs multi beam antennas creating narrow beams and operating in different frequency bands. Focusing dielectric lenses are the main part of the most efficient multi beam antennas. The diameter of a focusing lens has to be several wave lengths of the electromagnetic wave spreading through a lens to create a narrow beam, therefore some lenses of multi beam antennas for mobile communication have diameter more than 1 m. Such lenses made of usual dielectric materials are often too heavy, therefore much research has been done to create lightweight and low loss lenses providing desirable properties of focusing lenses.

The most well-known lightweight artificial dielectric materials consist of randomly oriented conductive parts mixed with non-conductive parts made of lightweight dielectric material. It is very difficult to manufacture uniform materials having desirable dielectric properties by random mixing of conductive and non-conductive parts, therefore a focusing lens is the most expensive component of multi beams antennas. To improve properties and decrease cost of focusing lenses, development of such materials is constantly continuing.

U.S. Pat. No. 8,518,537 B2 describes a lightweight artificial dielectric material comprising a plurality of randomly orientated small particles of lightweight dielectric material like polyethylene foam containing conductive fibers placed inside of each particle.

Patent application US 2018/0034160 A1 describes a lightweight artificial dielectric material comprising plurality of randomly orientated small multilayer particles of lightweight dielectric material containing thin conductive patches between layers. It is written in this application such multilayer particles provides more dielectric permittivity than particles containing conductive fibers.

Patent application US 2018/0034160 A1 describes other kinds of lightweight artificial dielectric material comprising plurality of randomly orientated small particles. One described material includes small multilayer particles of lightweight dielectric material containing thin conductive sheets between layers.

All mentioned above lightweight artificial dielectric materials are made by randomly mixing of small particles. Elimination of metal-to-metal contacts within the material that could lead to passive intermodulation distortion is needed, therefore manufacturing of such materials comprises many stages and its cost is high.

Randomly mixing provides isotropic properties of a final material consisting of small particles but some applications need dielectric material having anisotropic properties. For example a cylindrical lens made of anisotropic dielectric material can reduce depolarization of electromagnetic wave passed through the cylindrical lens and improve cross polarization ratio of multi beam antenna (U.S. Pat. No. 9,819,094 B2). The cylindrical lens made of isotropic artificial dielectric material creates depolarization of the electromagnetic wave passed through such lens therefore an antenna comprising such lens can suffer from high cross polarization level.

A lightweight artificial dielectric material providing anisotropic properties and suitable for manufacturing cylindrical lenses was described by NZ patent application 752904. This material consists of short conductive tubes having thin walls and placed inside of a lightweight dielectric material. Tubes are placed in layers. One layer comprises a sheet of a lightweight dielectric material containing plurality of holes. A lightweight dielectric material can be a foam polymer. Tubes are placed in holes made in a sheet of a lightweight dielectric material and contain air inside. Layers containing tubes are separated by layers of a lightweight dielectric material without tubes. The axes of all conductive tubes are directed perpendicular from layers.

Such structure could have effective dielectric permittivity ($\varepsilon$) up to 2.5 for electromagnetic waves spreading along axes of the tubes but its $\varepsilon$ for electromagnetic waves spreading in a perpendicular direction is significantly smaller.

It is desired to provide an improved light artificial dielectric material for manufacturing such devices as focusing lenses and antennas for radio communication. The provided material has to be simple for manufacturing and have repeatable properties.

SUMMARY OF THE INVENTION

In a first aspect of the invention, provided is an artificial dielectric material comprising a plurality of layered sheets of a dielectric material and a plurality of conductive elements disposed in holes made in the sheets of the dielectric material, wherein each conductive element is substantially tubular and comprises a slit along its length so as to provide a gap between two longitudinal edges.

Each conductive element may comprise a conductive material bent into a substantially tubular shape. Alternatively, each conductive element may comprises a conductive material attached to a dielectric substrate.

The holes in the dielectric material may contain projections adapted to be disposed in the slit separating the longitudinal edges of the conductive elements.

The conductive element may include slots, which may be disposed in parallel to the longitudinal edges of the conductive element.

The axes of the conductive elements are preferably orientated in at least two different directions, which may be orthogonal directions.

The conductive elements may have at least two different shapes. The substantially tubular conductive elements may have a cross section in the shape of a circle and/or a polygon.

Preferably, the dielectric material forming the plurality of layers is a foam polymer, where the foam polymer may be made of a material selected from polyethylene, polystyrene, polypropylene, polyurethane, silicon and polytetrafluoroethylene.

The conductive elements disposed in one layer may form a square lattice providing equal distances between neighboring elements disposed in the same row or same column. Alternatively, the conductive elements disposed in one layer form a honeycomb lattice providing equal distances between any neighboring conductive elements.

The axes of the conductive elements disposed in one layer may be directed in the same direction, either perpendicular to the layer, or parallel to the layer. Alternatively, the axes of some conductive elements disposed in one layer may be directed perpendicular to the layer and axes of other conductive elements in that layer are directed in parallel to the layer. The axes of the conductive elements directed in parallel to the layer may be directed in different directions, preferably orthogonal directions.

In another aspect of the invention, also provided herein is a focusing lens comprising an artificial dielectric material according to the invention and as described herein.

The conductive elements of each layer of the lens may form a sunflower lattice. Alternatively the conductive elements of each layer may be placed radially in circles.

The lens may comprise layers with conductive elements having axes directed only perpendicular to the layer and layers containing conductive elements having axes directed only in parallel to the layer.

The axes of the conductive elements of a first layer containing the conductive elements with axes directed only in parallel to the layer may be directed perpendicular to axes of the conductive elements of a second layer containing conductive elements with axes directed in parallel to the layer.

Each layer of the material of the lens may contain conductive elements with axes directed perpendicular to the layer and conductive elements with axes directed in parallel to the layer.

The lens may comprise at least two types of layers, wherein a first layer comprises conductive elements with axes directed parallel to the layer, and a second layer which comprises conductive elements with axes directed perpendicular to the axes of the conductive elements of the first layer.

The lens may contain layers where each layer contains circles of conductive elements having axes directed perpendicular to the layer and circles of conductive elements having axes directed in parallel to the layer. At least one circle may contain conductive elements having axes directed in parallel to the layer and in parallel to the circle. At least one circle may contain conductive elements having axes directed in parallel to the layer and perpendicular to the circle.

The lens may comprise a dielectric rod placed along the longitudinal axis of the cylindrical focusing lens.

In another aspect of the invention, also provided herein is a spherical focusing lens comprising the artificial dielectric material according to the invention and as described herein.

In another aspect of the invention, also provided herein is a method for manufacturing the artificial dielectric material described herein, comprising placing conductive elements in a plurality of sheets of a dielectric material, and stacking said sheets together, wherein the sheets of the dielectric material containing the conductive elements are separated by sheets of the dielectric material without the conductive elements, and wherein axes of the conductive elements are orientated in at least two different directions.

The conductive elements may be placed into pre-existing holes in the sheets of the dielectric material. The conductive elements may be flat and are bent into the required shape at the time of being placed into pre-existing holes in the sheets of the dielectric material.

The provision of the gap between the longitudinal edges of the conductive element stops circular currents flowing on the surface of the conductive element.

The holes in the lightweight dielectric material may contain projections to be disposed in the gap separating the longitudinal edges of the conductive element.

The conductive element may contain slots disposed in a surface to decrease circular currents flowing on a surface of the conductive element in other directions. The conductive material disposed on the surface of a dielectric film increases solidity of the thin conductive element while not overly increasing weight.

The conductive elements are placed in layers. One layer comprises a sheet of the lightweight dielectric material containing plurality of holes. The lightweight dielectric material can be a foam polymer. The layers containing conductive elements may be separated by layers of a lightweight dielectric material without the conductive elements. The separating layers may also contain holes having a smaller diameter than diameter of holes for the conductive elements in order to provide air ventilation through the lightweight dielectric material and lenses made thereof.

By providing the above artificial dielectric material, the invention goes at least some way to overcoming deficiencies of known lightweight artificial dielectric materials and to provide a light artificial dielectric material with less dependence from direction and polarization of electromagnetic waves spreading through the material.

Because $\varepsilon$ depends of angle between direction of electromagnetic wave crossing the material and axes of conductive elements, existing artificial dielectric materials do not suit for many applications requiring an isotropic dielectric material providing the same value of $\varepsilon$ for any direction and polarization of electromagnetic wave. For example spherical Luneburg lenses have to be made of isotropic dielectric material having the same $\varepsilon$ for any direction and polarization of electromagnetic wave to keep polarization of electromagnetic wave passed through spherical lens. Therefore a need exists to create the artificial dielectric material providing lesser dependence of $\varepsilon$ from direction and polarization of electromagnetic wave crossing the material compared with known materials. At the same time manufacturing of such material has to be simpler than manufacturing of known lightweight artificial materials made by randomly mixing of small elements containing conductive elements isolated from each other.

Focusing properties of an artificial dielectric material depend on delay coefficient $n=\sqrt{\varepsilon\mu}$, where $\mu$ is efficient magnetic permeability. As an electromagnetic wave passes through the known artificial dielectric material, this excites currents in the conductive material and $\mu$ of such material is less than 1. The biggest circular currents flow on a wall of a conductive tube in direction perpendicular to the axis of the conductive tube when the magnetic field of an electromagnetic wave is directed in parallel to the axis of a conductive tube. As a result $\mu$ and n for such polarization is less than for other polarizations. Artificial dielectric materials containing the conductive tubes suffer from such effect, therefore it is needed to find other shapes of conductive elements to increase $\mu$ and delay coefficient n.

The words "tubular" or "tube" as used in relation to the invention are broad in nature and refer to an elongated hollow object. Such object may have a cross-section which is circular, but equally may have another cross-sectional shape including, but not limited to square, hexagonal or octagonal.

BRIEF DESCRIPTION OF THE DRAWINGS

In further describing the invention, reference is made to the accompanying drawings by way of example only in which.

Figure 10A:
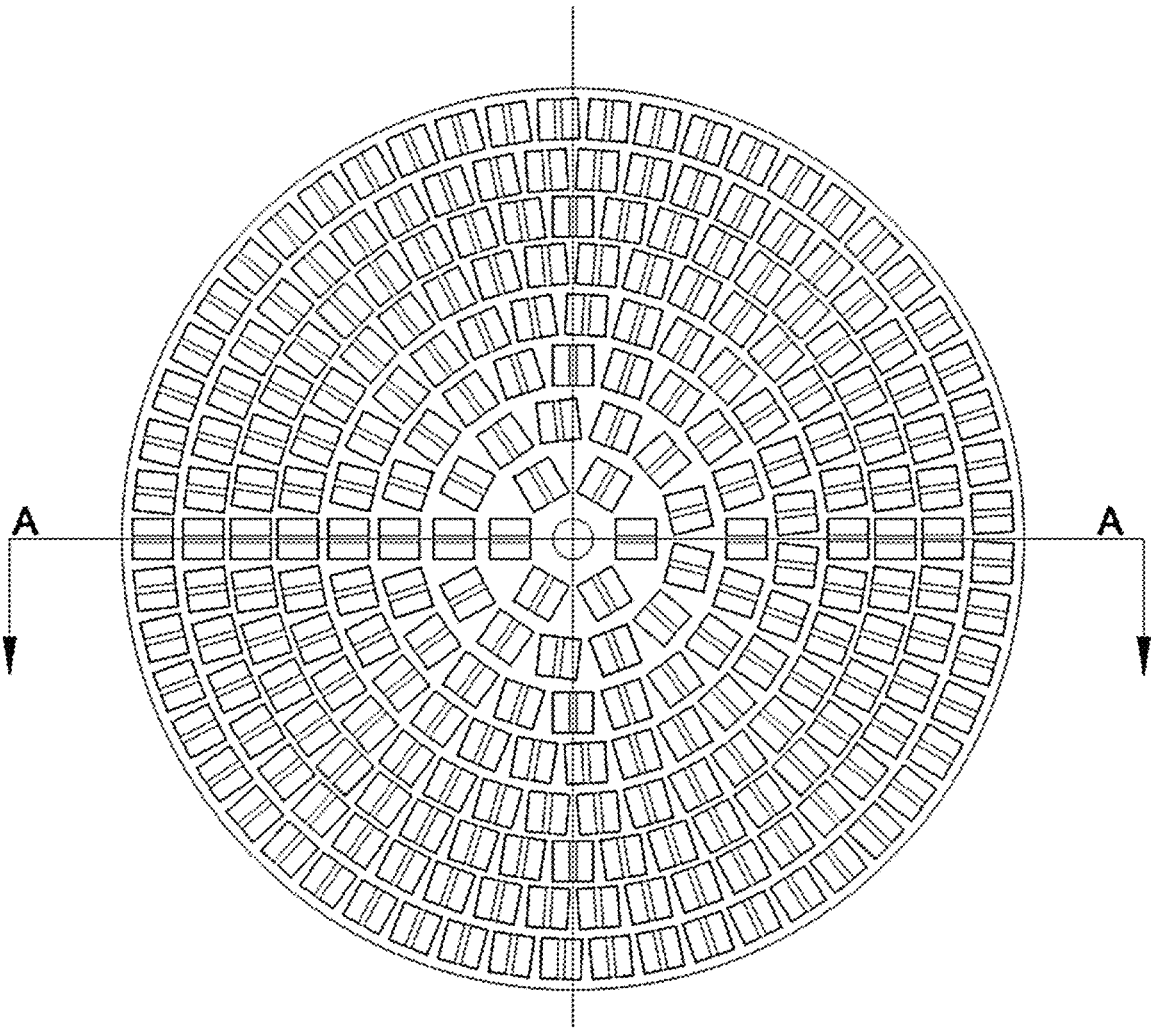
FIG. 10*a* shows the top view of a first layer of a cylindrical lens where conductive elements are placed in radial circles about a central conductive element with its axis directed perpendicular to the layer. Axes of the conductive elements forming the radial circles are directed in parallel to the layer and perpendicular to the circles.
Figure 11A:
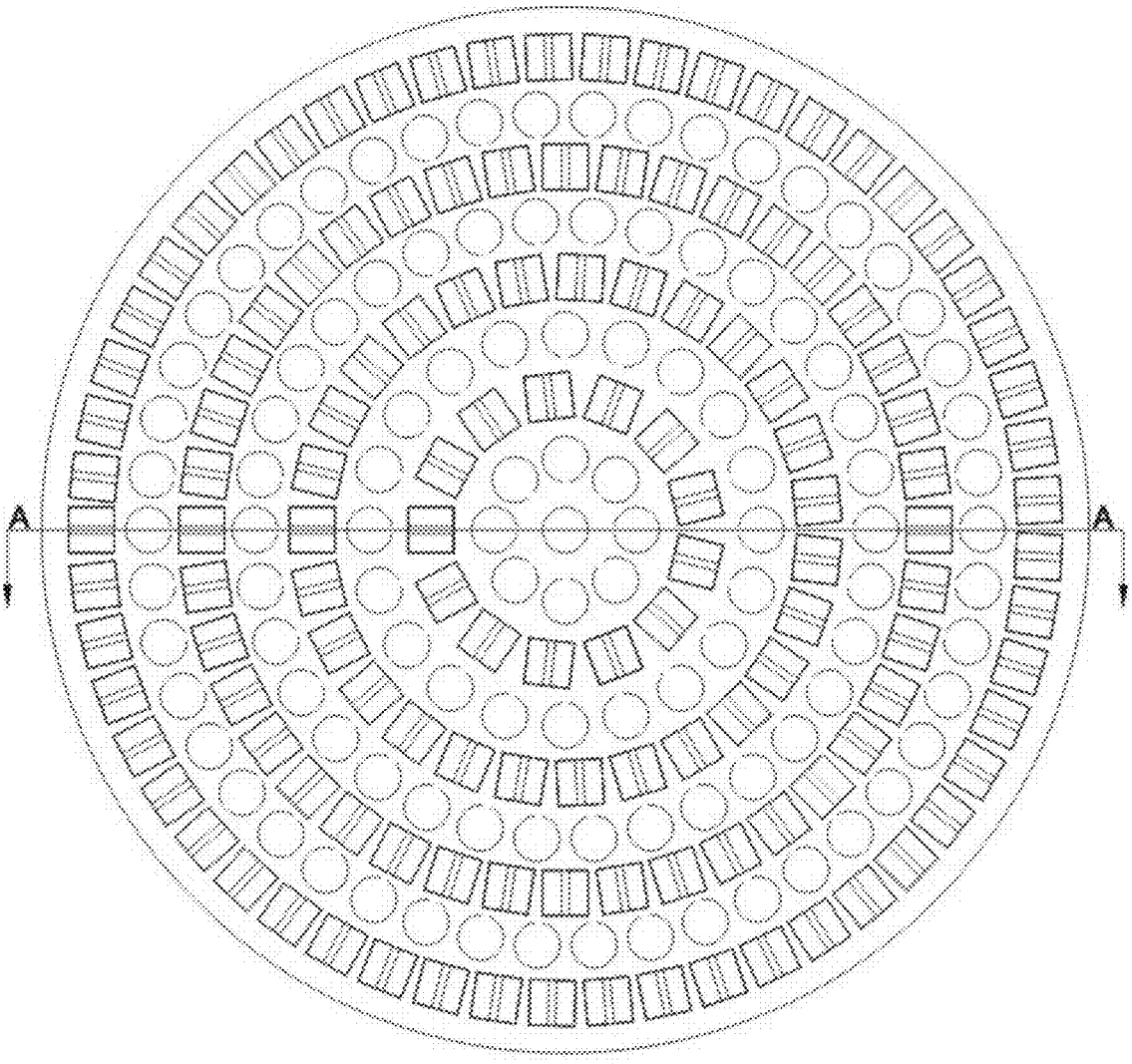
Figure 11B:
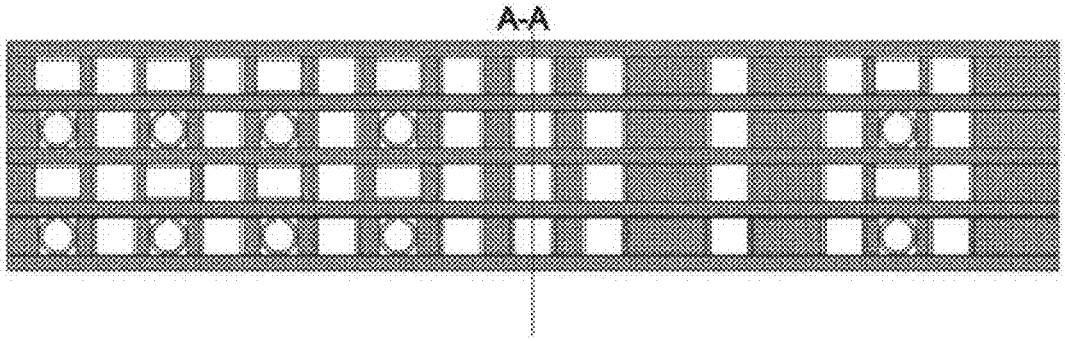
Figure 11C:
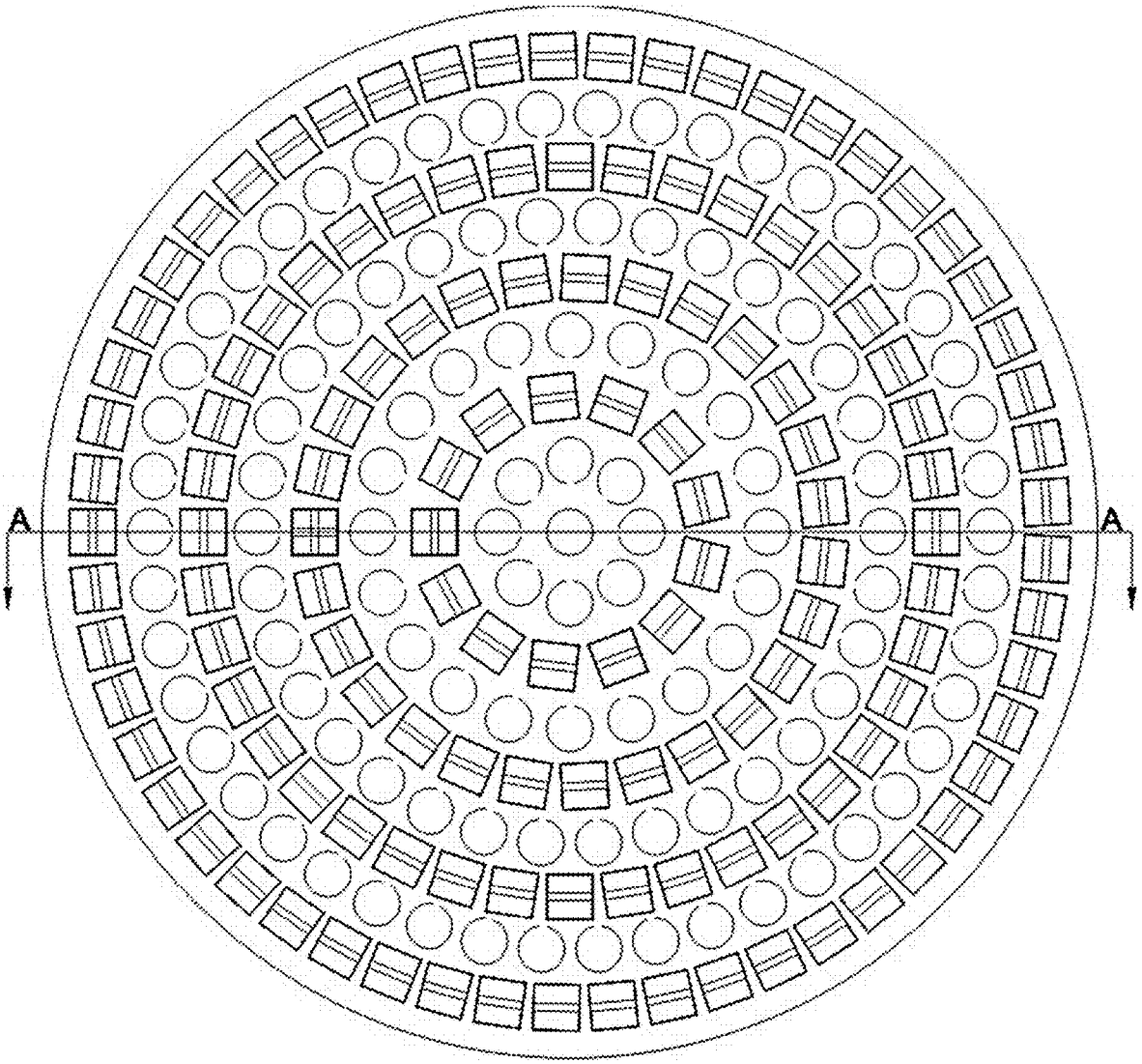
Figure 12A:
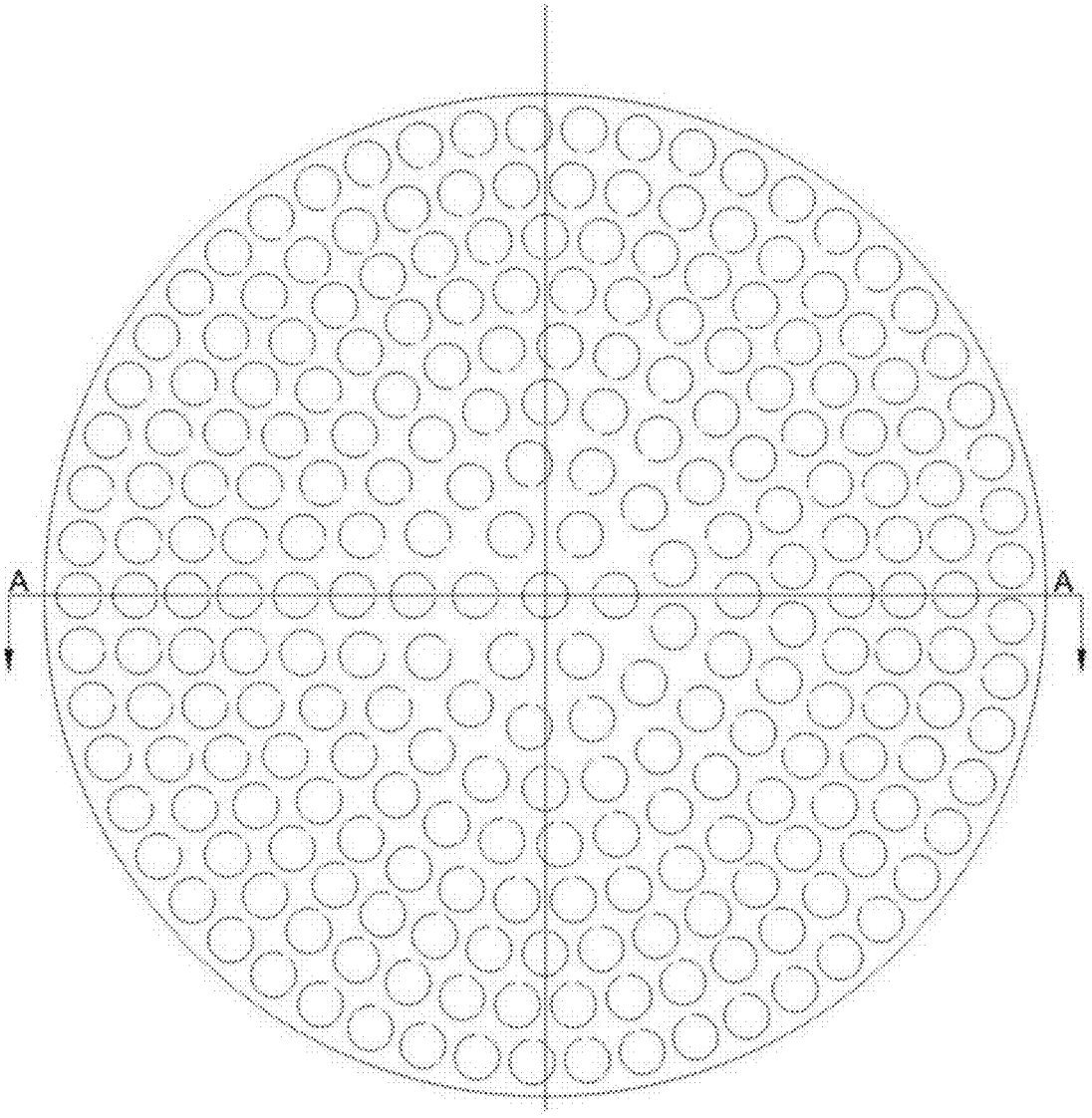
Figure 12B:
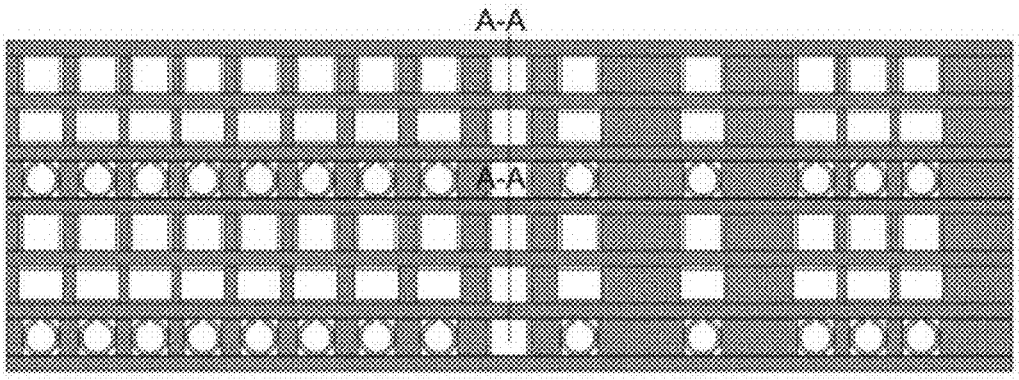

Another embodiment of the invention is shown in FIGS. 11*a*-11*c* where each layer of a cylindrical lens comprises a plurality of conductive elements with one slit placed in circles and having two orthogonal orientations of its axes;

FIG. 11*a* shows the top view of the first layer. Axes of conductive elements placed in a first circle from the outer contour of the lens are perpendicular to the circle. Axes of conductive elements placed in the second circle from the outer contour of the lens are directed perpendicular to the layer;

FIG. 11*b* shows the cross section of a cylindrical lens comprising four layers of the conductive elements where the layers correspond to FIGS. 11*a* and 11*c*. The first layer and the second layer have a different orientation of conductive elements placed in alternating circles. The first layer and the third layer are equal corresponding to FIG. 11*a*. The second layer and the fourth layers are equal corresponding to FIG. 11*c*. Thus such lens is assembled of two kinds of different layers;

FIG. 11*c* shows the top view of the second layer. Axes of conductive elements placed in the first circle from the outer contour of the lens are directed parallel to the circle. Axes of conductive elements placed in the second circle from the outer contour of the lens are directed perpendicular to the layer;

Another embodiment of the present invention is shown in FIGS. 12*a* and 12*b* where each layer of a cylindrical lens comprises a plurality of conductive elements of a circular cross section with one slit placed in radial circles about the central axis of the layer;

FIG. 12*a* shows the top view of the first layer of a cylindrical lens where conductive elements are placed in circles and the axes of the conductive elements are directed perpendicular to the layer. The top view of the second layer is shown in FIG. 10*a*. The top view of the third layer is shown in FIG. 10*c;*

Figure 5A:
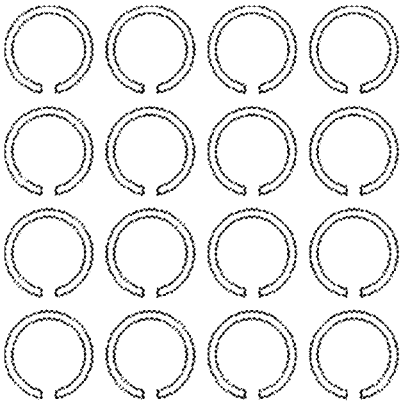
FIG. 5*a* shows the top view of a layer of conductive elements placed in rows where axes of the conductive elements are perpendicular to the layer and distances between conductive elements of neighboring rows and distances between neighboring conductive elements of one row are equal.
Figure 5B:
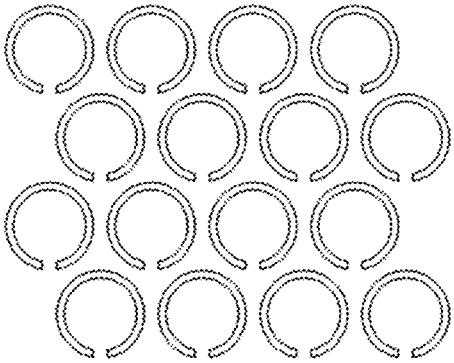
FIG. 5*b* shows the top view of a layer containing rows of conductive elements where axes of the conductive elements are perpendicular to the layer. The rows are shifted by a distance of half the diameter of a conductive elements between neighboring rows and distances between any neighboring conductive elements are equal.
Figure 5C:
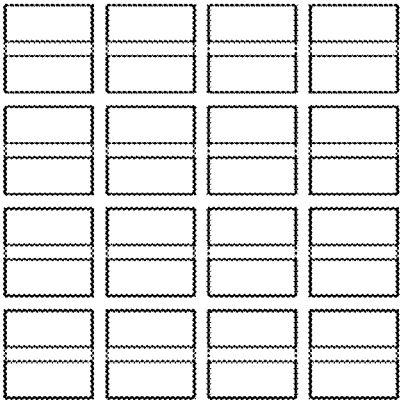
FIG. 5*c* shows the top view of a layer containing conductive elements placed in rows where axes of all conductive elements are parallel to layer and parallel to each other.
Figure 5D:
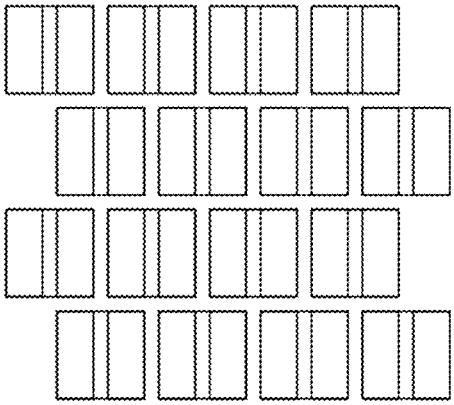
FIG. 5*d* shows the top view of a one layer containing conductive elements placed in rows where axes of conductive elements are in parallel to layer and in parallel to each other. Rows are shifted by a distance of half the diameter of a conductive element between neighboring conductive elements placed in one row.
Figure 5E:
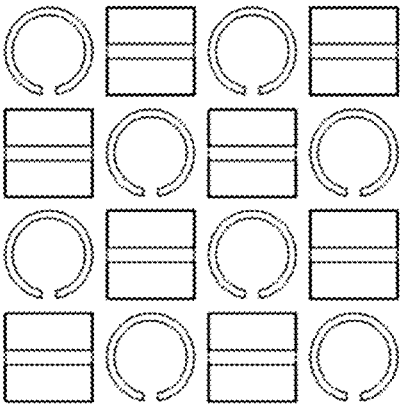
FIG. 5*e* shows the top view of a layer containing conductive elements placed in rows where axes of one half of the conductive elements are directed perpendicular to the layer and axes of the other half of the conductive elements are directed parallel to the layer. Each row contains conductive elements which alternate with axes directed perpendicular to the layer and conductive elements with axes directed parallel to the layer.
Figure 5F:
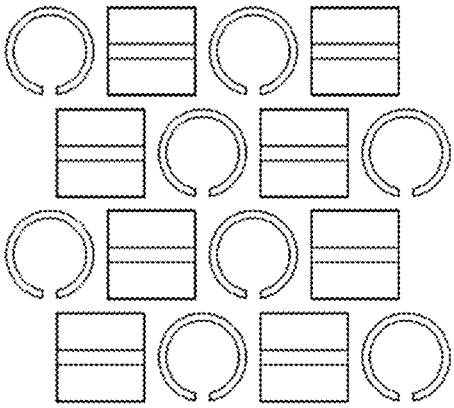
FIG. 5*f* shows the top view of a one layer containing conductive elements placed in rows where axes of one half of the conductive elements are directed perpendicular to the layer and axes of other half of the conductive elements are directed in parallel to the layer. Each row contains conductive elements with axes directed perpendicular to layer and conductive elements with axes directed in parallel to layer. The neighboring rows are shifted by a distance of half the diameter of a conductive element relative to the neighboring rows.
Figure 10B:
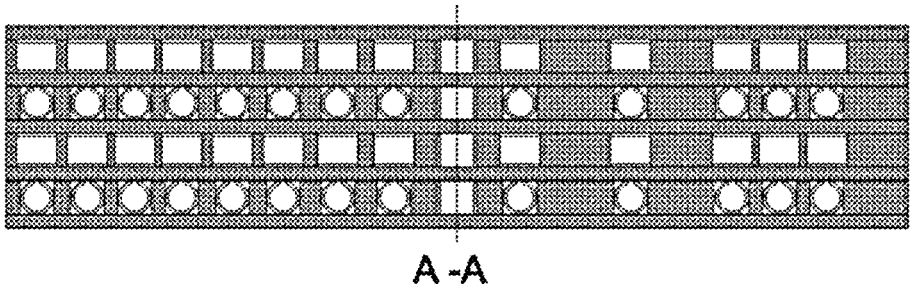
FIG. 10*b* show the cross section of a cylindrical lens comprising four layers corresponding to FIGS. 10*a* and 10*c*. The first layer and the third layer are equal. The second layer and the fourth layers are equal. Thus such lens is assembled of two kinds of different layers.
Figure 10C:
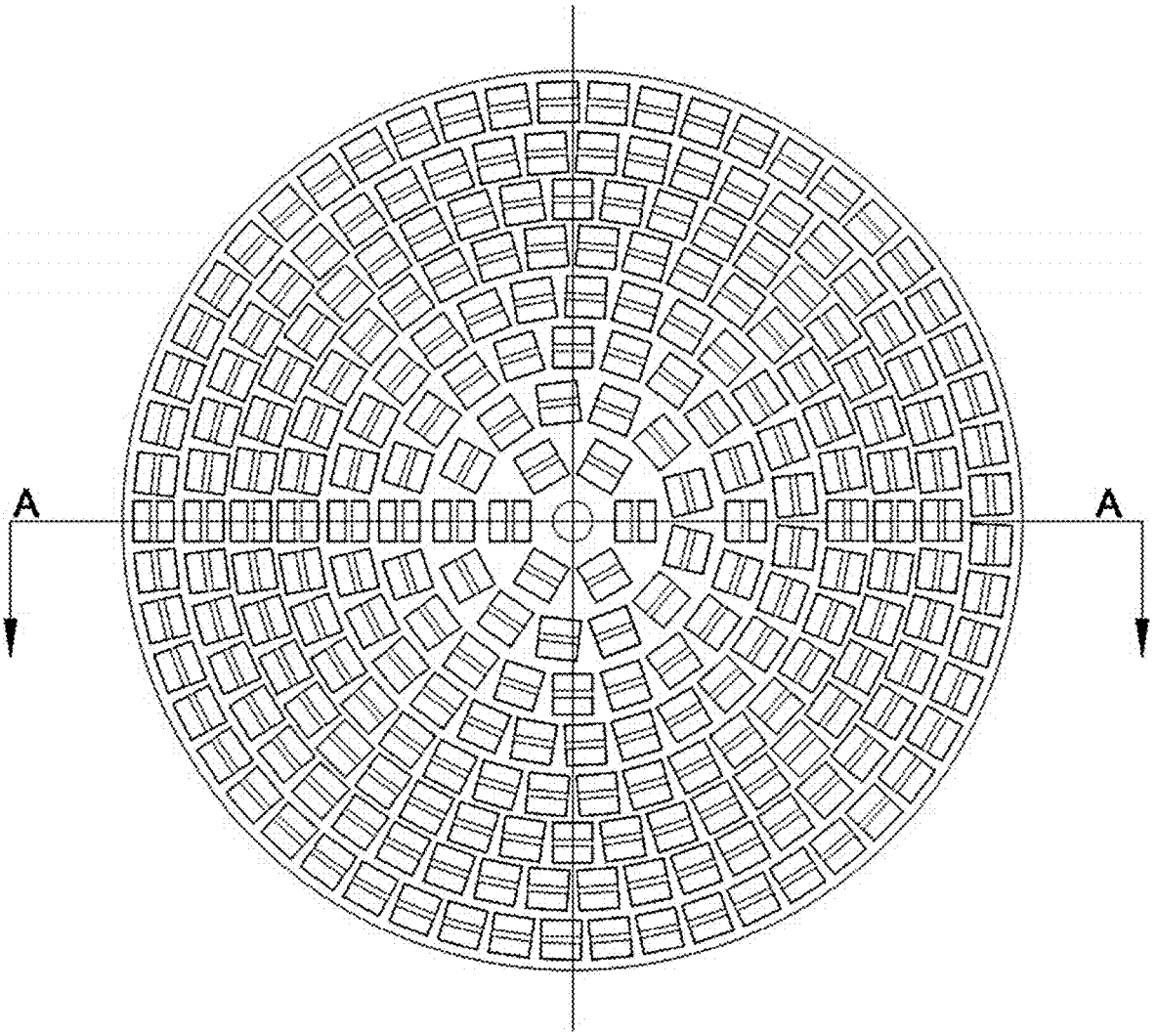
FIG. 10*c* shows the top view of a layer of a cylindrical lens where conductive elements are placed in radial circles about a central conductive element with its axis directed perpendicular to the layer. Axes of the conductive elements forming the radial circles are directed in parallel to the layer and parallel to the circles.
Figure 13A:
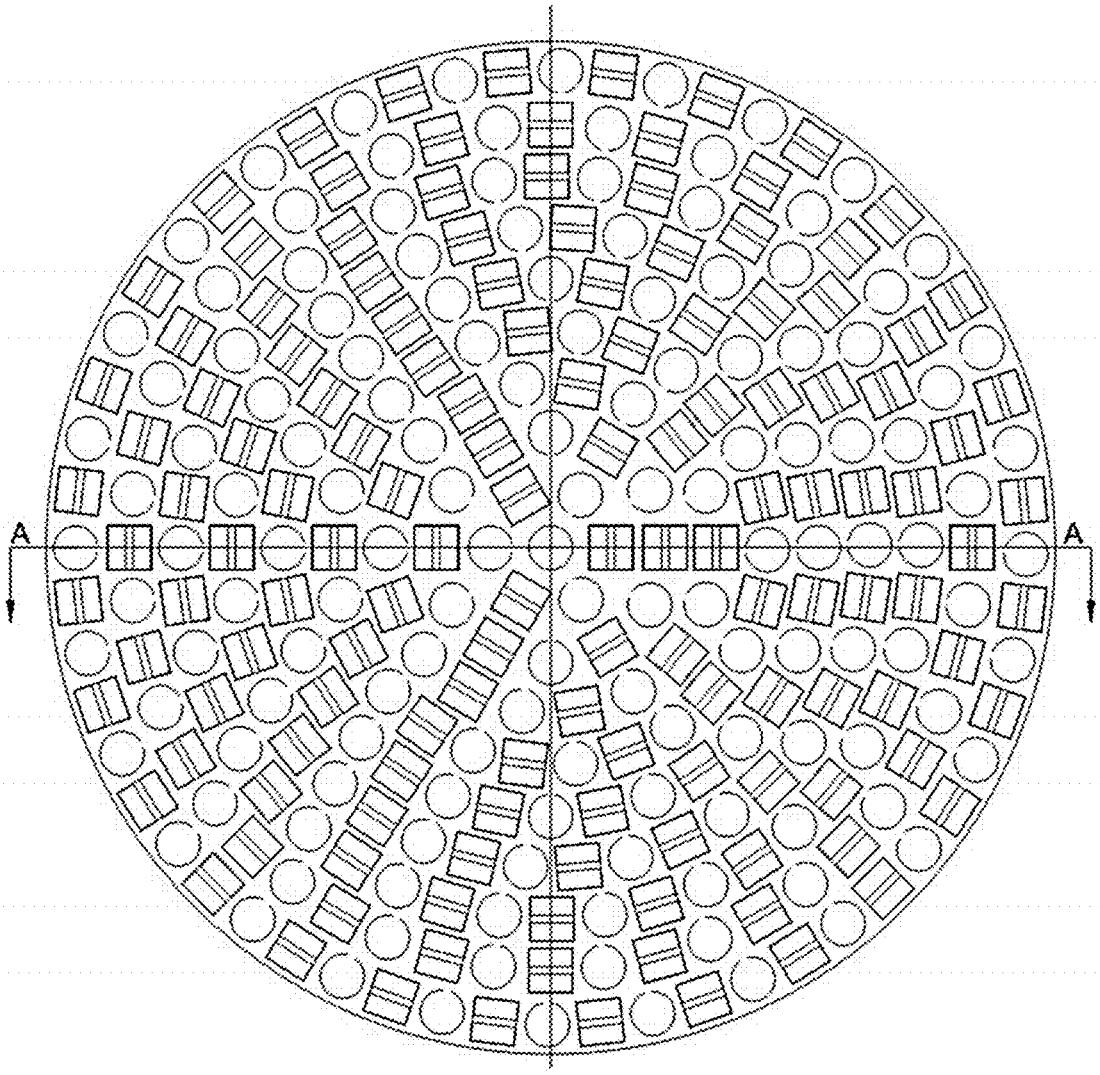
Figure 13B:
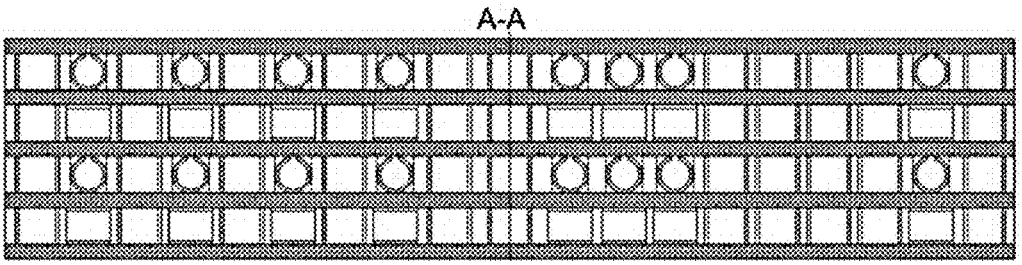
Figure 14A:
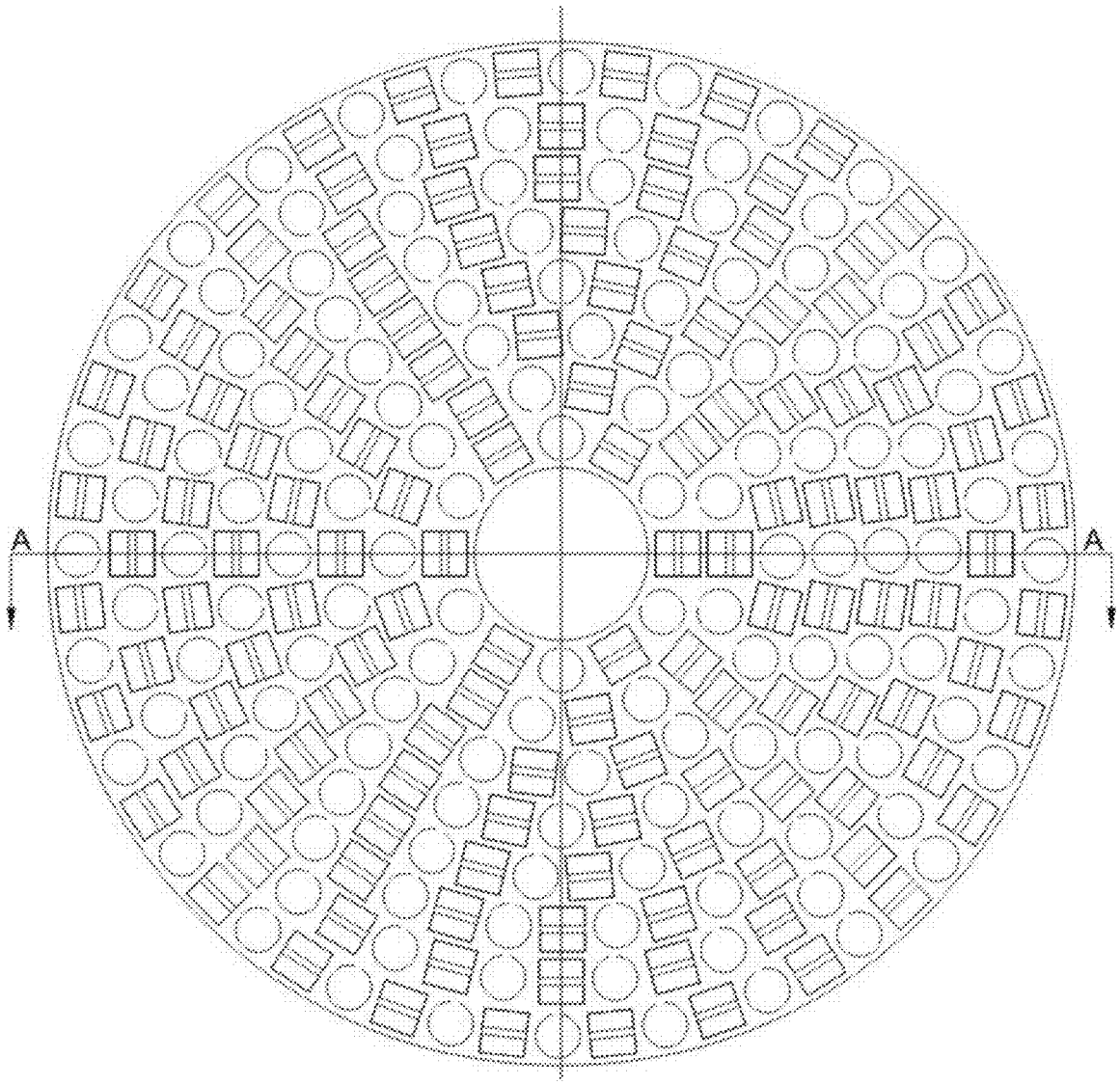
Figure 14B:
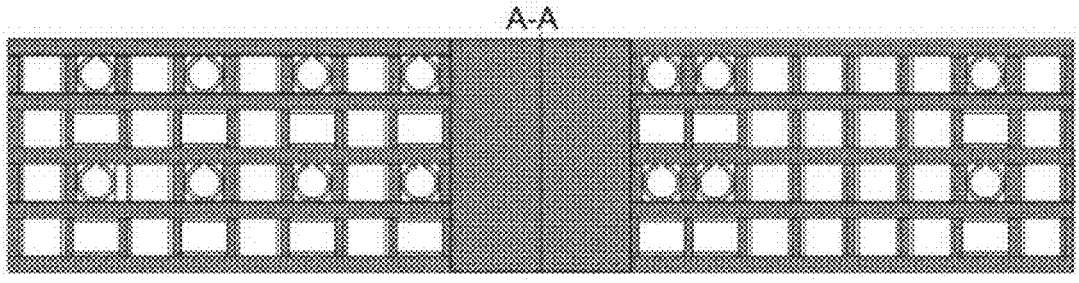
Figure 15A:
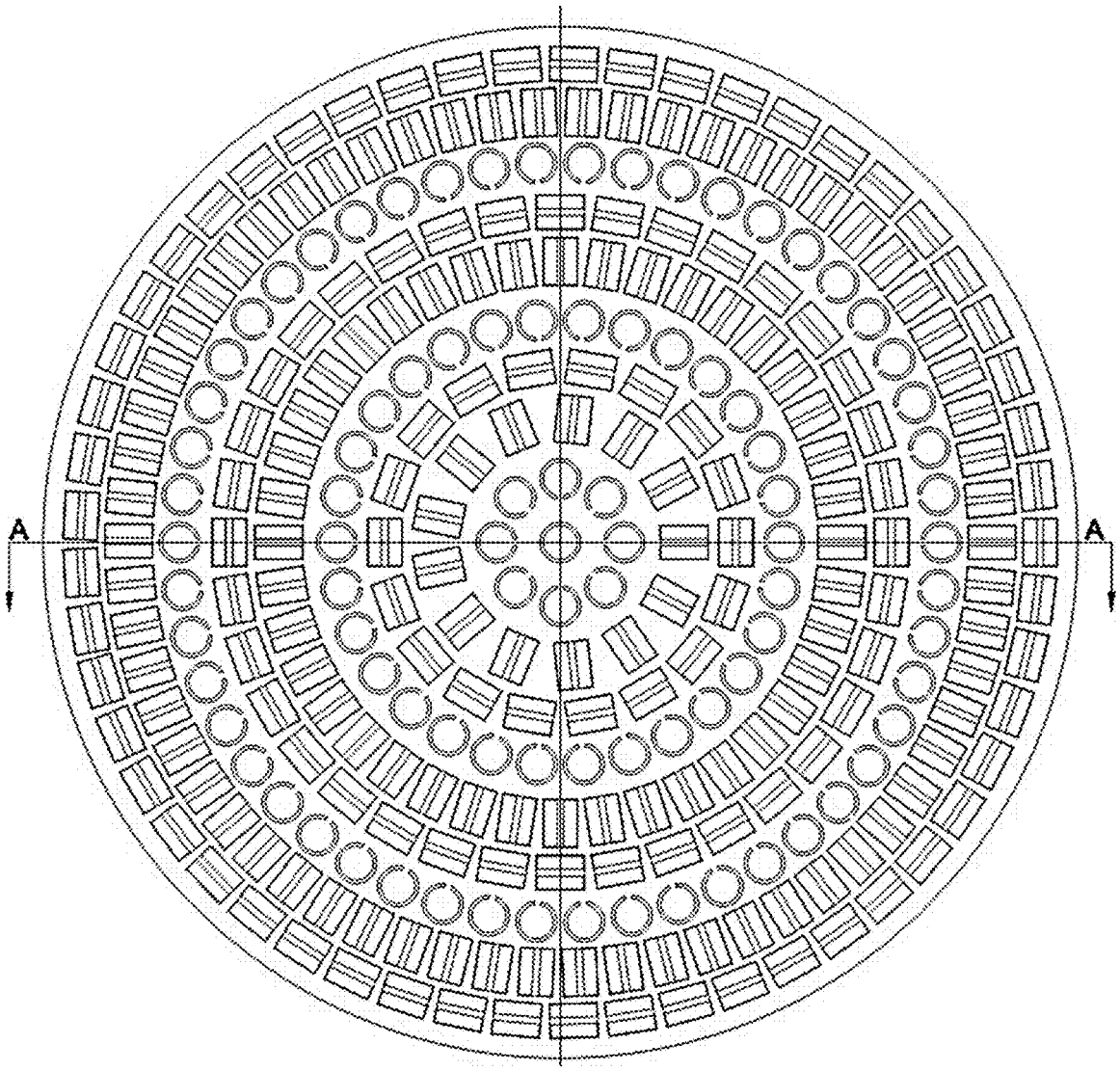
Figure 15B:
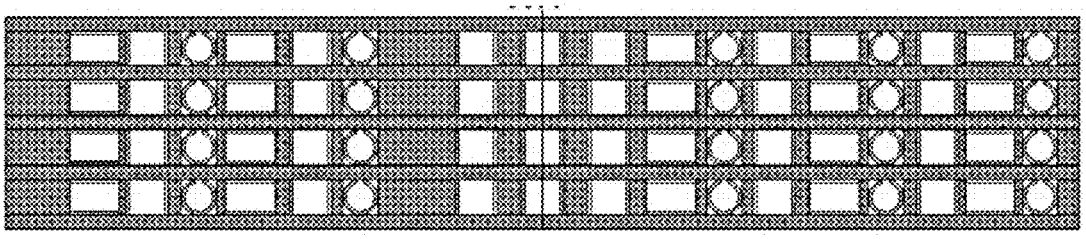

FIG. 12*b* shows the cross section of a cylindrical lens comprising six layers of conductive elements corresponding to FIGS. 12*a*, 10*a* and 10*c*. The first layer and the fourth layer are equal corresponding to FIG. 12*a*. The second layer and the fifth layers are equal corresponding to FIG. 10*a*. The third layer and the sixth layer are equal, corresponding to FIG. 10*c*. Thus such lens is assembled of three kinds of different layers;

Another embodiment of the invention is shown in FIGS. 13*a* and 13*b* where each layer of a cylindrical lens comprises a plurality of conductive elements having a circular cross section and a slit placed in circles and having two orthogonal orientations of their axes;

FIG. 13*a* shows the top view of the first layer of a cylindrical lens where conductive elements form structure shown in FIGS. 5*e* and 5*f*. The conductive elements are placed in circles around the central axis of the layer and each circle contains conductive elements with axes directed perpendicular to the layer and conductive elements with axes directed in parallel to the layer;

FIG. 13*b* shows the cross section of a cylindrical lens comprising four layers of the conductive elements. Conductive elements of the first layer with axes directed parallel to the layer are directed along the circles. Conductive elements of the second layer with axes directed in parallel to the layer are directed perpendicular to the circles. The first layer and the third layer are equal. The second layer and the fourth layers are equal. Thus such lens is assembled of two kinds of different layers;

Another embodiment of the invention is shown in FIGS. 14*a* and 14*b* where a cylindrical lens made of the provided lightweight artificial dielectric material of the invention comprises a rod made of dielectric material placed in the middle of the cylindrical lens. Such rod increases delay coefficient n in the middle of the cylindrical lens and provides mechanical support for the lightweight dielectric sheets forming the lens. Layers of the cylindrical lens shown in FIGS. 14*a* and 14*b* have the same structure as layers of the cylindrical lens shown in FIGS. 13*a* and 13*b*; Another embodiment of the invention is shown in FIGS. 15*a* and 15*b* where each layer of a cylindrical lens comprises a plurality of conductive elements placed in circles and having three orthogonal orientations of their axes;

FIG. 15*a* shows the top view of a layer. Axes of conductive elements placed in the first circle from the outer contour of the lens are directed in parallel to the layer and parallel to the circle. Axes of conductive elements placed in the second circle from the outer contour of the lens are directed in parallel to a layer and perpendicular to the circle. Axes of conductive elements placed in the third circle from the outer contour of the lens are directed perpendicular to the layer. Axes of conductive elements forming the first, fourth and seventh circles are directed in parallel to the circles. Axes of conductive elements forming the second, fifth and eight circles are directed perpendicular to the circles. Axes of conductive elements forming the third, sixth and ninth circles are directed perpendicular to the layer and these conductive elements are shorter than other conductive elements forming the layer;

FIG. 15*b* shows the cross section of a cylindrical lens containing four equal layers shown in FIG. 15*a*. Thus such lens is assembled of layers of one kind only.

Throughout the Figures, sectional lines A-A are used to indicate sections in corresponding drawings of the same set. For example in FIGS. 9*a*-9*d*.

DETAILED DESCRIPTION OF THE INVENTION

As described and shown in the figures, the artificial dielectric material includes a plurality of substantially tubular objects, described herein as conductive elements, disposed in holes made in sheets of a lightweight dielectric material.

Each conductive element is substantially tubular and comprises a slit along its length so as to provide a gap between two longitudinal edges. The conductive element is preferably formed by bending a conductive patch into the desired shape, where the cross-section of the substantially tubular conductive element may be substantially circular or another polygon such as square, hexagonal or octagonal.

In addition to the slit along its length so as to provide a gap between two longitudinal edges, the conductive element may comprise one or more slots forming gaps in the conductive element. The slots may extend between, but not to the edges of the conductive element, or may be disposed at one or more edges of the conductive element. Typically, the conductive element is made from a piece of a suitably conductive metal which may be referred to as a conductive patch. The conductive metal, such as aluminium, is bent into the required shape either by manual or mechanical means. The metal may alternatively be copper, nickel, silver, gold, or another suitable conductive metal.

Alternatively, the conductive material may consist of a conductive material patch attached to a thin sheet or film of a lightweight resilient dielectric material such that it can be formed into a required shape. A preferred example is the use of a polyethylene film coated by aluminium. However, alternative dielectric material substrates could be used in combination with a suitable conductive material. The dielectric material may be coated with a thin layer of conductive material in order to form the conductive element or vice versa where the dielectric material is coated with the conductive metal.

The conductive elements are placed in layers. One layer comprises a sheet of a lightweight dielectric material containing plurality of holes filled by the conductive elements. The lightweight dielectric material can be a foam polymer. The foam polymer is preferably made of a material selected from polyethylene, polystyrene, polypropylene, polyurethane, silicon and polytetrafluoroethylene. The layers containing conductive elements may be separated by layers of a dielectric material without conductive elements. The separating layers could be a foam polymer or a thin dielectric film. The separating layers also could contain holes having smaller diameter than diameter of holes for conductive elements to provide air ventilation through the lightweight dielectric material.

Figure 1A:
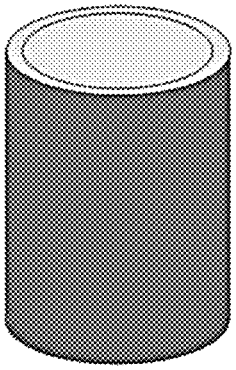
Fig. 1a (Prior Art)
FIGS. 1*a*-1*c* show known tubular conductive elements.
Figure 1B:
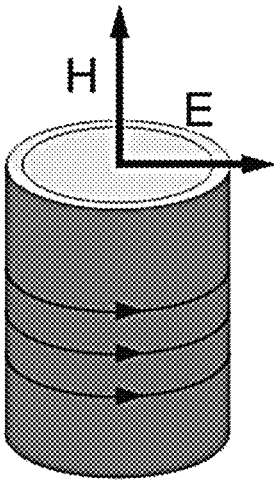
Fig. 1b (Prior Art)
Figure 2A:
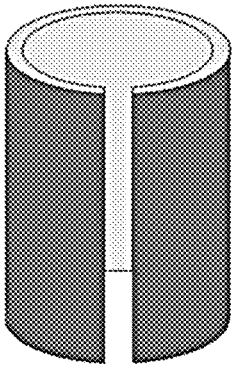
FIGS. 2*a*-2*c* show conductive elements according to the invention including a slit along the length so as to provide a gap between two longitudinal edges.

Two samples of the artificial dielectric material were manufactured to compare properties of the material of the invention and known material. The first sample was made of known material containing short conductive elements in the shape of tubes as shown in FIG. 1*a*. The second sample was made of the proposed material containing the conductive elements bent in a shape of short tubes having a slit along its length so as to provide a gap between two longitudinal edges as shown in FIG. 2*a*. Both samples have the same dimensions and contain tubes of the same dimensions placed at the same distances. Measurements of magnetic properties of the artificial dielectric material containing conductive elements with slits did show increasing μ compared with the known artificial dielectric material containing conductive tubes without slits when the magnetic field of an electromagnetic wave is directed in parallel to an axis of the conductive tube. The measured sample of the known artificial dielectric material has μ=0.69. FIG. 1*b* shows currents flowing on a wall of the known tube when the magnetic field of an electromagnetic wave is directed in parallel to an axis of the short conductive tube.

Figure 2B:
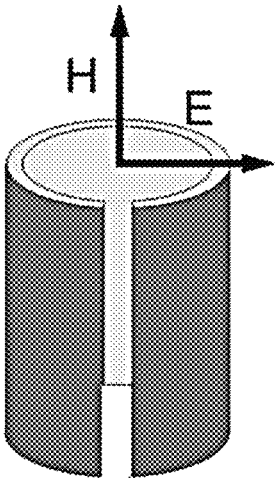

In comparison, the measured sample of the artificial dielectric material of the invention has μ=0.87. The presence of the slit along its length so as to provide a gap between two longitudinal edges stops currents flowing around the conductive element as is shown in FIG. 2*b*.

Figure 1C:
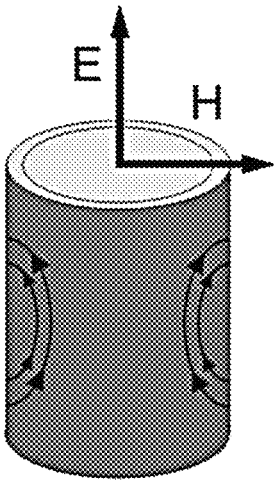
Fig. 1c (Prior Art)
Figure 2C:
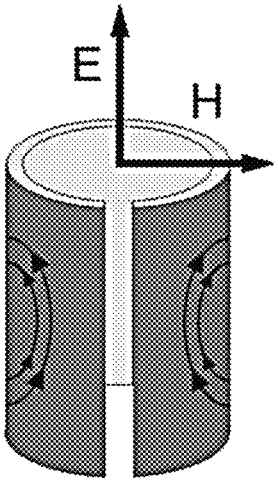

The difference between magnetic properties of the known material and the material of the invention is smaller when the magnetic field of an electromagnetic wave is directed perpendicular to an axis of a conductive element. The known artificial dielectric material has μ=0.81. FIG. 1*c* shows currents flowing on a wall of the tube when the magnetic field of an electromagnetic wave is directed perpendicular to an axis of a conductive tube. The proposed artificial dielectric material has μ=0.84. FIG. 2*c* shows currents flowing on a wall of the conductive element when the magnetic field of an electromagnetic wave is directed in perpendicular to an axis of the conductive element.

The proposed artificial dielectric material of the invention having larger μ correspondingly provides larger delay coefficient n than the known artificial dielectric material because both materials have almost the same ε.

The proposed artificial dielectric material provides less dependence n from polarization of electromagnetic waves than the known material because μ of the proposed material is less dependent on polarization of electromagnetic waves.

Wave impedance (Z) of the artificial dielectric material expressed in terms of effective permittivity ε and effective permeability μ is $$Z = 376.73\sqrt{\frac{\mu}{\varepsilon}}.$$

This formula shows Z increasing when μ increases therefore the artificial dielectric material of the invention has larger Z than the known material. As a result reflection from the provided material is less than reflection from the known material.

Figure 3A:
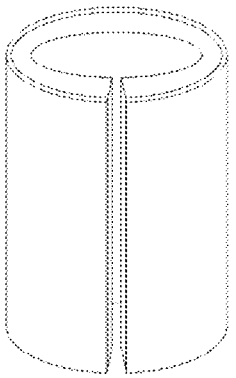
FIG. 3*a* shows a conductive element according to the invention comprising a conductive patch disposed on the surface of a dielectric film and including a slit along the length so as to provide a gap between two longitudinal edges.

An embodiment of the present invention is shown in FIG. 3*a* where the conductive element comprises the conductive material disposed on the surface of a dielectric film. This arrangement may increase solidity and resilience of the conductive element for an element of the same thickness meaning less conductive material is required. The conductive element comprising such a dielectric film can therefore be made with a thickness of several microns only, but could be thicker depending on use requirements. Use of such conductive elements containing the dielectric film covered by a thin conductive layer allows decreased weight of the provided artificial dielectric material for the same thickness where the dielectric material weighs less than the conductive material.

Figure 3B:
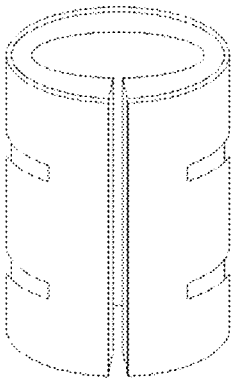
FIG. 3*b* shows a conductive element comprising a conductive patch disposed on the surface of a dielectric film and containing slots between opposite edges.

Another embodiment of the present invention is shown in FIG. 3*b* where the conductive element contains slots in the conductive element between, but not extending to, the edges of the conductive element. Such slots inhibit the circular currents excited by electromagnetic waves when a magnetic field is directed perpendicular to the longitudinal axis of the conductive element and increases μ of the provided material for this polarization. Conductive materials including slots which may be shaped to form conductive elements according to the invention are shown in FIGS. 4*b*, 4*e* and 4*f*.

Figure 3C:
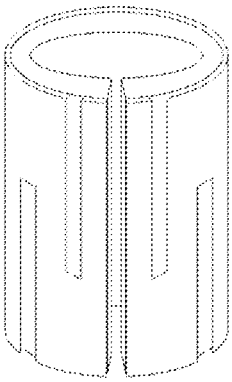
FIG. 3*c* shows a conductive element comprising a conductive patch disposed on the surface of a dielectric film and containing slots disposed at edges of the conductive element.

Another embodiment of the present invention is shown in FIG. 3*c* where the conductive element contains slots disposed at edges of the conductive element. Such slots also inhibit the circular currents shown in FIG. 2*c*.

Figure 4A:
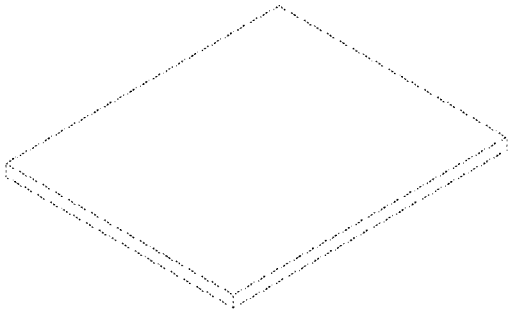
FIG. 4*a* shows a conductive patch for producing a conductive element according to the invention.
Figure 4B:
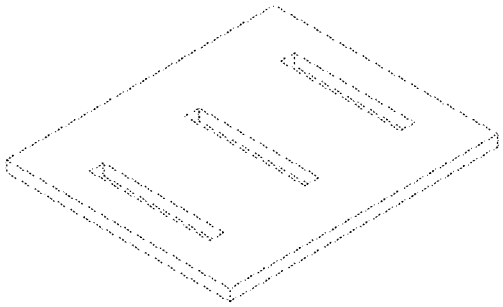
FIG. 4*b* shows a conductive patch containing slots disposed between opposite edges for producing a conductive element according to the invention.
Figure 4C:
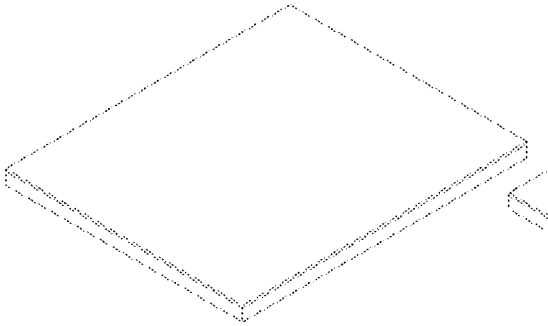
FIG. 4*c* shows a conductive patch disposed on a surface of a dielectric film for producing a conductive element according to the invention.
Figure 4D:
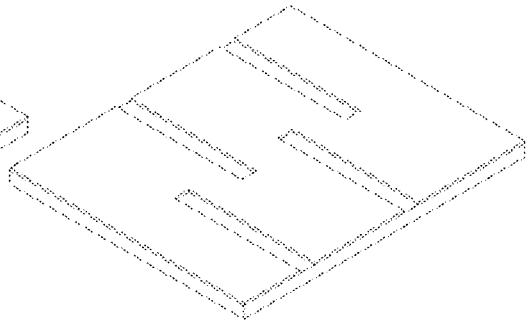
FIG. 4*d* shows a conductive patch disposed on a surface of a dielectric film and containing slots disposed at opposite edges for producing a conductive element according to the invention.
Figure 4E:
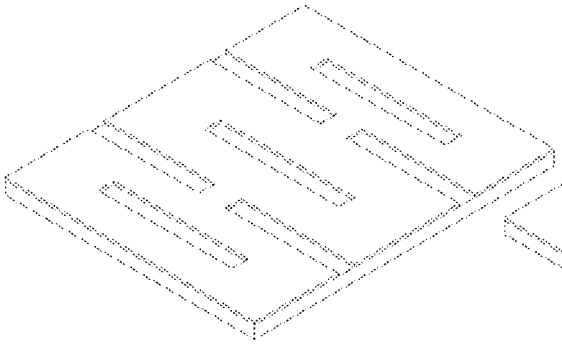
FIG. 4*e* shows a conductive patch disposed on a surface of a dielectric film and containing slots disposed between opposite edges and at opposite edges for producing a conductive element according to the invention.
Figure 4F:
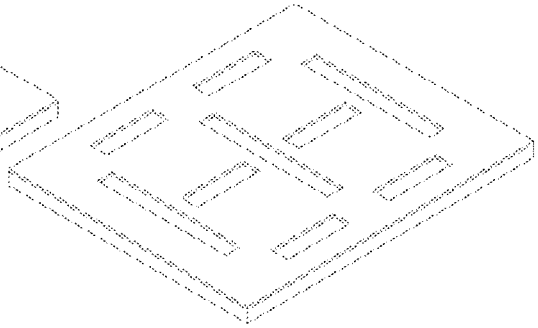
FIG. 4*f* shows a conductive patch disposed on a surface of a dielectric film and containing slots oriented in different directions for producing a conductive element according to the invention.

Different shapes of the conductive patches for manufacturing conductive elements according to the invention are shown in FIGS. 4*a*-4*f*. FIG. 4*a* shows an unaltered conductive patch. FIG. 4*b* shows a conductive patch containing slots disposed between, but not extending to the edges of the patch. FIG. 4*c* shows a conductive patch disposed on the surface of a dielectric film. FIG. 4*d* shows a conductive patch disposed on a surface of the dielectric film and containing slots disposed at edges of the conductive patch. FIG. 4*e* shows a conductive patch disposed on the surface of a dielectric film and containing slots disposed at edges of the conductive patch, and slots between, but not extending to the edges of the patch. FIG. 4*f* shows a conductive patch disposed on the surface of a dielectric film and containing slots between, but not extending to the edges of the patch, where the slots are oriented in different directions.

The patches shown in FIGS. 4*a*-4*f* can be bent to form the conductive element into substantially tubular shape and comprising a slit along its length so as to provide a gap between two longitudinal edges.

The conductive elements may be disposed in the artificial dielectric material with different orientations of their axes. Axes of some conductive elements are directed perpendicular to the layers in which they are placed (see FIG. 9*a*) and axes of other conductive elements are directed in parallel to the layers (see FIGS. 9*b* and 9*c*). The conductive elements having axes directed in parallel to the layers could be disposed perpendicular to each other. Thus the axes of the conductive elements have three potential orthogonal directions. As a result dielectric properties of the provided lightweight artificial dielectric material are less dependent on the direction and polarization of electromagnetic waves crossing the material.

The conductive elements placed in one layer could have the same orientation of axes (see FIG. 12*a*) or different orientation (see FIG. 13*a*). Layers placed above each other may contain conductive elements having the same structure and orientation or different structure and orientation. For example, adjacent layers or sheets of the same size with the conductive elements arranged in radial circles may have differing numbers of radial circles in order to increase the distance between the circles. Similarly, for honeycomb lattice arrangements, distances between adjacent conductive elements in the same layer may be varied.

Properties of the provided artificial dielectric material, such as dielectric permittivity depend on orientation of the conductive elements and distances between these and between the layers. Therefore the provided artificial dielectric material comprising conductive elements having slits, slots, different orientation of axes in a layer, and layers with different structures provides opportunity to reach desirable dielectric properties compared with known materials. For example it is possible to decrease dependence of delay coefficient n from direction and polarization of electromagnetic waves passing through the provided artificial dielectric material. As a result the provided artificial dielectric material can be applied for manufacturing of many kinds of focusing lenses and antennas.

Several embodiments of the present invention are shown in FIGS. 5*a*-5*h* where conductive elements with a circular cross-section placed in one layer may form different structures and orientations.

FIG. 5*a* shows the top view of a layer of conductive elements placed in rows where axes of the conductive elements are perpendicular to the layer and distances between conductive elements of neighboring rows and distances between neighboring conductive elements of one row are equal.

FIG. 5*b* shows the top view of a layer containing rows of conductive elements where axes of the conductive elements are perpendicular to the layer. The rows are shifted by a distance of half the diameter of a conductive element between neighboring rows and distances between any neighboring conductive elements are equal.

FIG. 5*c* shows the top view of a layer containing conductive elements placed in rows where axes of all conductive elements are parallel to layer and parallel to each other.

FIG. 5*d* shows the top view of a one layer containing conductive elements placed in rows where axes of conductive elements are in parallel to layer and in parallel to each other. Rows are shifted by a distance of half the diameter of a conductive element between neighboring conductive elements placed in one row.

FIG. 5*e* shows the top view of a layer containing conductive elements placed in rows where axes of one half of the conductive elements are directed perpendicular to the layer and axes of the other half of the conductive elements are directed parallel to the layer. Each row contains conductive elements which alternate with axes directed perpendicular to the layer and conductive elements with axes directed parallel to the layer.

FIG. 5*f* shows the top view of a one layer containing conductive elements placed in rows where axes of one half of the conductive elements are directed perpendicular to the layer and axes of other half of the conductive elements are directed in parallel to the layer. Each row contains conductive elements with axes directed perpendicular to layer and conductive elements with axes directed in parallel to layer. The neighboring rows are shifted by a distance of half the diameter of a conductive element relative to the neighboring rows.

Figure 5G:
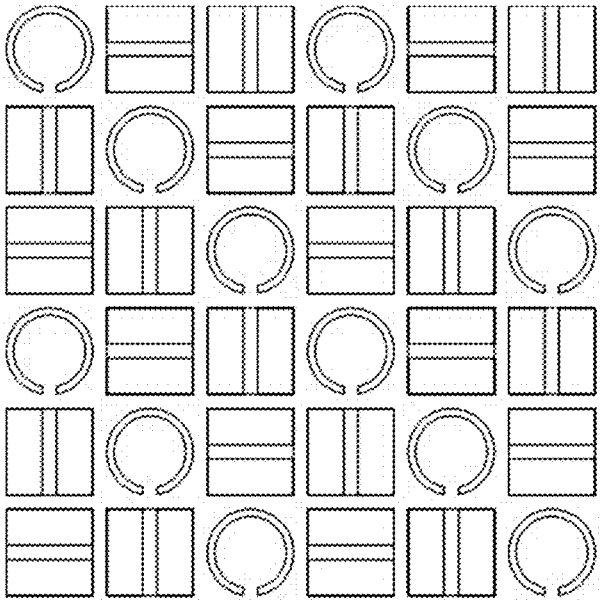
FIG. 5*g* shows the top view of a layer containing conductive elements placed in rows where axes of one third of the conductive elements are directed perpendicular to the layer and axes of other conductive elements are directed in parallel to the layer. Of the conductive elements directed parallel to the layer, axes of one half of these are directed perpendicular to the axes of the other half.

FIG. 5*g* shows the top view of a layer containing conductive elements placed in rows where axes of one third of the conductive elements are directed perpendicular to the layer and axes of other conductive elements are directed in parallel to the layer. Of the conductive elements directed parallel to the layer, axes of one half of these are directed perpendicular to the axes of the other half.

Figure 5H:
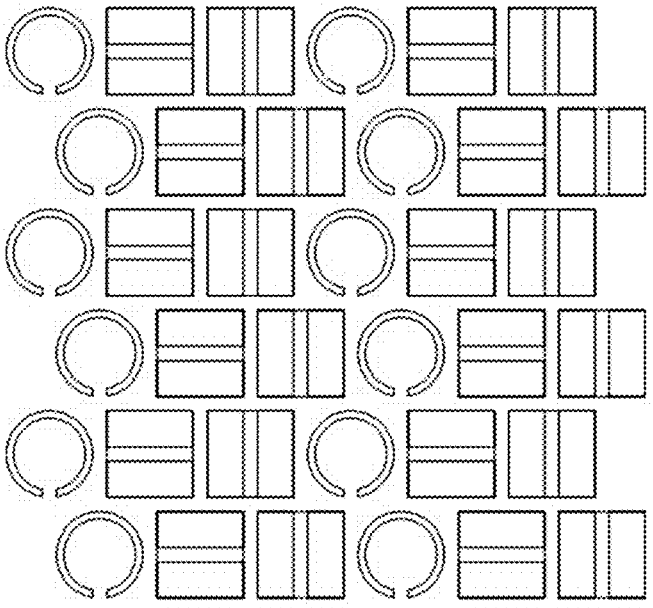
FIG. 5*h* shows the top view of a layer containing conductive elements placed in rows where axes of one third of the conductive elements are directed perpendicular to the layer and axes of the other conductive elements are directed in parallel to layer. Of the conductive elements directed parallel to the layer, axes of one half of these are directed perpendicular to the axes of the other half. The neighboring rows are shifted by a distance of half the diameter of a conductive element, relative to the neighboring rows.

FIG. 5*h* shows the top view of a layer containing conductive elements placed in rows where axes of one third of the conductive elements are directed perpendicular to the layer and axes of the other conductive elements are directed in parallel to layer. Of the conductive elements directed parallel to the layer, axes of one half of these are directed perpendicular to the axes of the other half. The neighboring rows are shifted by a distance of half the diameter of a conductive element, relative to the neighboring rows.

Figure 6A:
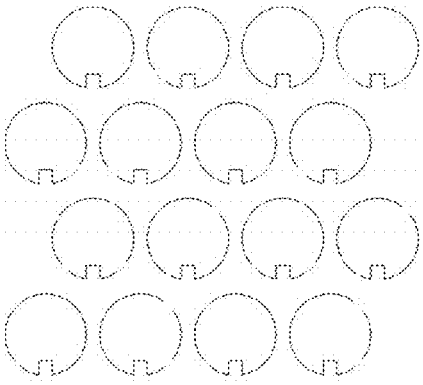
FIGS. 6*a* and 6*b* show a top view of holes in the lightweight dielectric material for the conductive elements in the shape of a circular cross section with a groove along a wall adapted to engage with the slit in the conductive element.
Figure 6B:
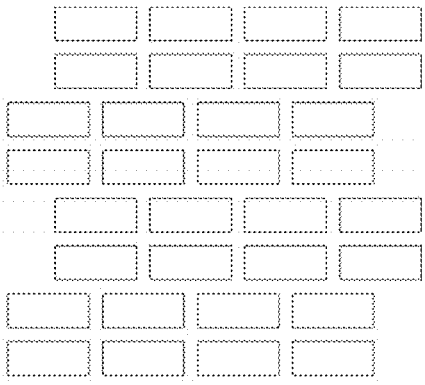

FIGS. 6*a* and 6*b* show examples of the nature of holes inside a lightweight dielectric material for housing conductive elements having a circular cross section. The holes shown in FIG. 6*a* contain projections along a wall of the hole adapted to engage with the slit in the conductive element and separate the longitudinal edges of the conductive element, when the conductive elements are positioned with their axes perpendicular to the layer. The holes shown in FIG. 6*b* contain a separating wall to separate the longitudinal edges of the conductive elements when the conductive elements are positioned with their axes parallel to the layer. The separating wall separates each hole for the conductive element into two parts. This arrangement is also shown in the cross-section in FIG. 9*d*. Alternatively, holes in the dielectric material which do not include a projection or a separating wall can be used.

The conductive elements shown at FIGS. 5*a*-5*h* have cross section that is generally circular, however it is possible to use conductive elements having other shapes of cross section, for example a shape of any polygon. Several example shapes of a cross section of the conductive elements including a slit along their length so as to provide a gap between two longitudinal edges are shown in FIGS. 7*a*-7*d*.

Figure 7A:
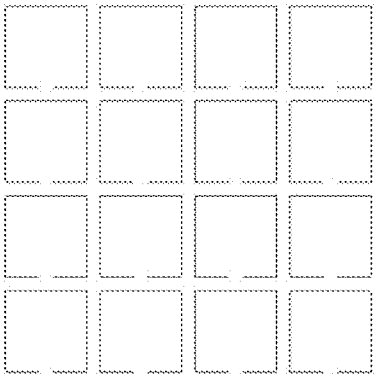
FIG. 7*a* shows the top view of a layer of conductive elements with a square cross section having a slit through the middle of a side of the square, where the elements are placed in rows where distances between neighboring conductive elements are equal.

FIG. 7*a* shows the top view of a layer of conductive elements with a square cross section having a slit through the middle of a side of the square, where the elements are placed in rows where distances between neighboring conductive elements are equal. The conductive elements of a square cross-section could provide a larger value of s compared with conductive elements of a circular cross-section shape but their weight is larger.

Figure 7B:
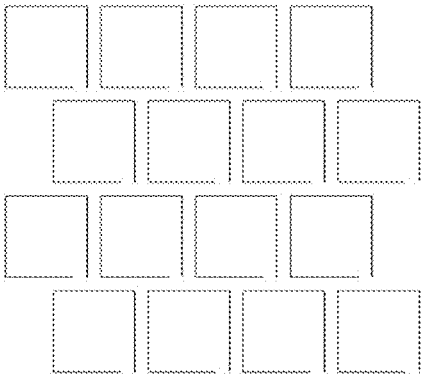
FIG. 7*b* shows the top view of a layer of conductive elements with a square cross section having a slit at the corner of the square, where the elements are placed in rows which are shifted by a distance of half the diameter of the conductive elements relative to the neighboring rows and distances between any neighboring conductive elements are equal.

FIG. 7*b* shows the top view of a layer of conductive elements with a square cross section having a slit at the corner of the square, where the conductive elements are placed in rows which are shifted by a distance of half the diameter of the conductive elements relative to the neighboring rows and distances between any neighboring conductive elements are equal.

Figure 7C:
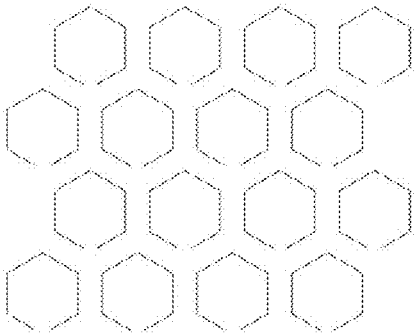
FIG. 7*c* shows the top view of a layer containing conductive elements having hexagonal cross section with a slit at a corner of the hexagon, where the conductive elements are placed in positions providing equal distances between any edges of any neighboring conductive elements.

FIG. 7*c* shows the top view of a layer containing conductive elements having hexagonal cross section with a slit at a corner of the hexagon, where the conductive elements are placed in positions providing equal distances between any edges of any neighboring conductive elements.

Figure 7D:
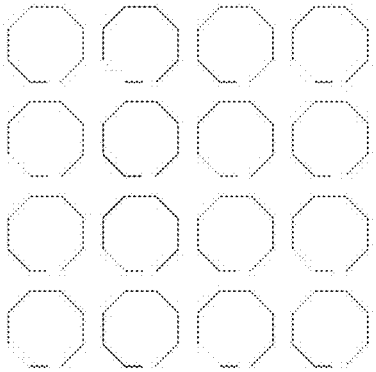
FIG. 7*d* shows the top view of a layer containing conductive elements having octagonal cross section with a slit at the corner of the octagon and placed in rows where distances between conductive elements of neighboring rows and distances between neighboring conductive elements of the same row are equal.

FIG. 7*d* shows the top view of a layer containing conductive elements having octagonal cross section with a slit at the corner of the octagon, where the conductive elements are placed in rows where distances between conductive elements of neighboring rows and distances between neighboring conductive elements of the same row are equal.

The conductive elements placed in neighboring layers could be placed above each other on the same axes or shifted from each other and have different axes.

Figure 9A:
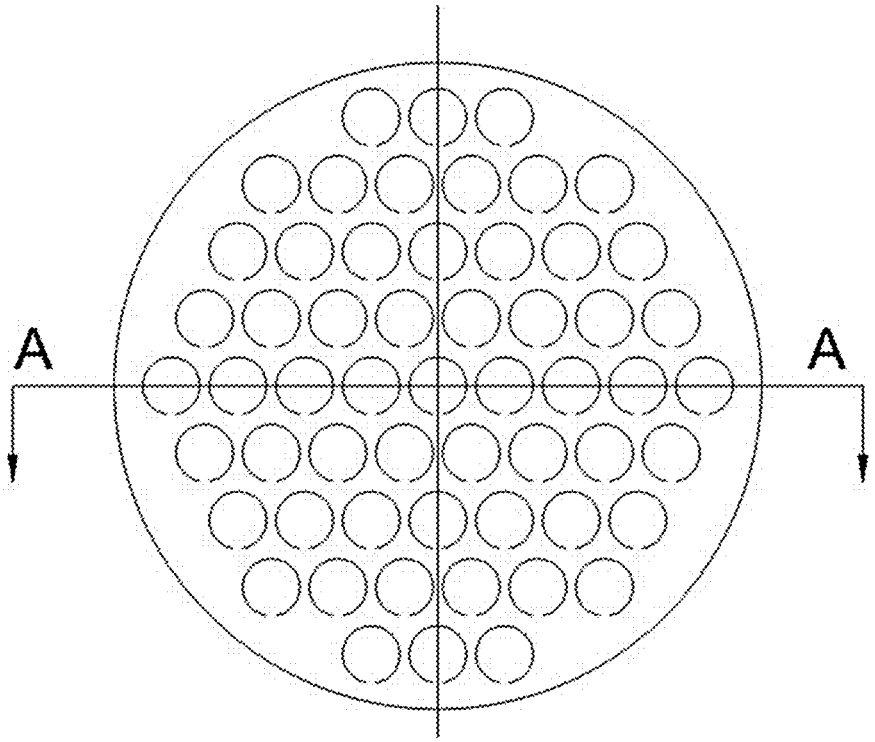
FIG. 9*a* shows the top view of the first layer of a cylindrical lens where conductive elements with a circular cross section and one slit are placed in rows and axes of the conductive elements are directed perpendicular to the layer. Distances between neighboring conductive elements are equal.
Figure 9B:
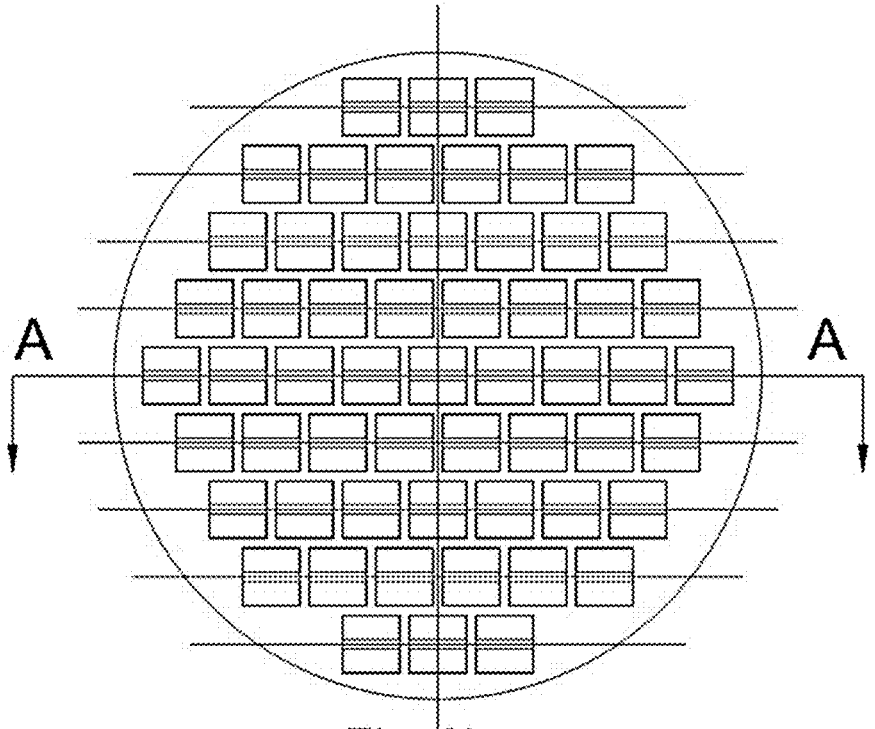
FIG. 9*b* shows the top view of the second layer of a cylindrical lens where conductive elements with a circular cross section and one slit are placed in rows and axes of the conductive elements are directed in parallel to the layer. Distances between neighboring conductive elements are equal.
Figure 9C:
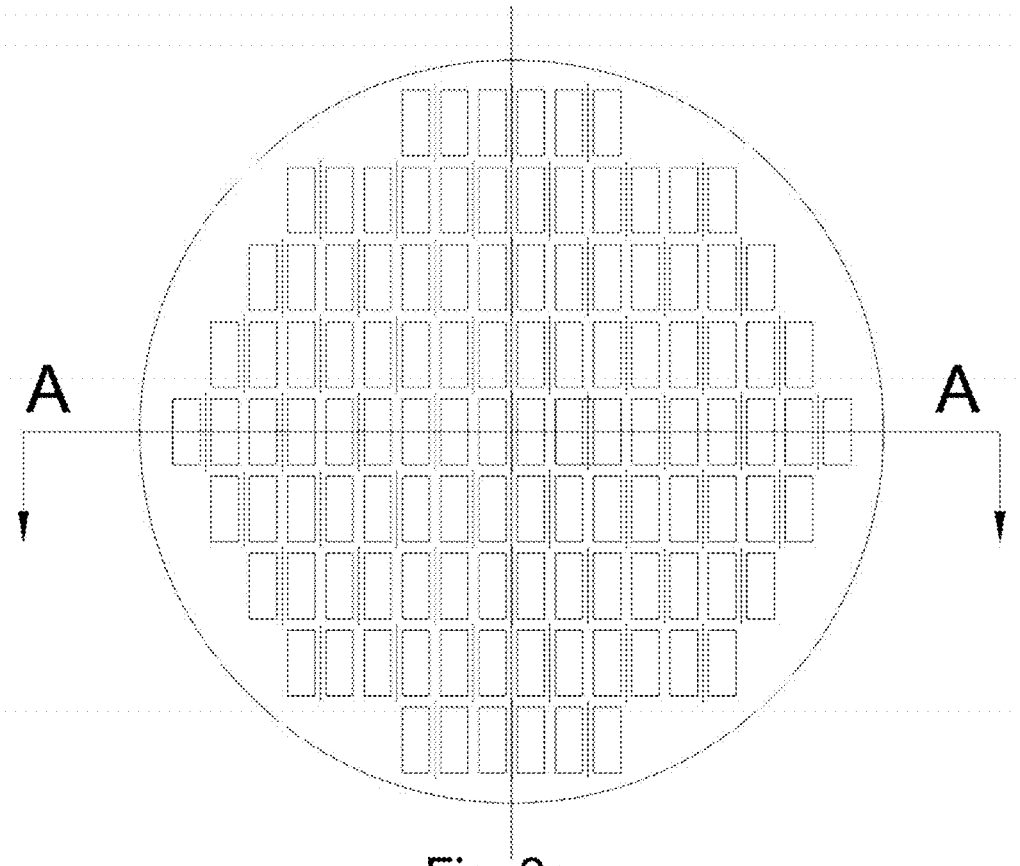
FIG. 9*c* shows the top view of the third layer of a cylindrical lens where conductive elements with a circular cross section and one slit are placed in rows and axes of the conductive elements are directed in parallel to the layer and perpendicular to the rows. Distances between neighboring conductive elements are equal.

The conductive elements placed in one layer may form various lattices of conductive elements in order to adopt suitable properties. These include a square structure (lattice) providing equal distances between neighboring conductive elements disposed at the same row or at the same column as shown in FIGS. 6*a* and 6*c* for example. Alternatively, the conductive elements placed in one layer form a honeycomb or hexagonal structure (lattice) providing equal distances between any neighboring conductive elements as shown in FIGS. 9*a*-9*c*. Alternatively, the conductive elements placed in one layer form a sunflower structured lattice constituted of radial circles as shown in FIG. 11*a* for example.

Several embodiments of a cylindrical lens made of the provided artificial dielectric material are described with reference to the figures.

Figure 8:
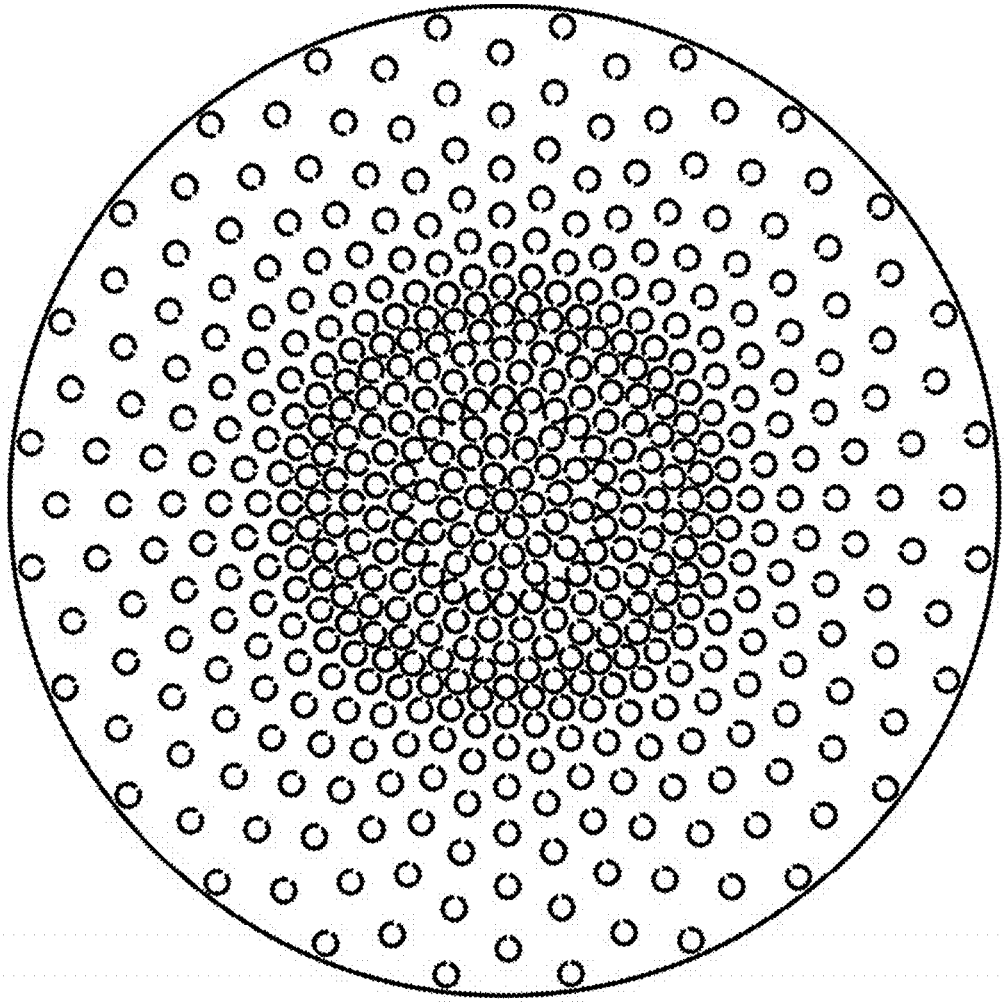
FIG. 8 shows the top view of one layer of a cylindrical lens where conductive elements with a circular cross section and a slit are placed about the radius of a cylinder.

FIG. 8 shows the top view of one layer of a cylindrical lens where conductive elements with a circular cross section and a slit are placed along the radius of a cylinder. Distances between conductive elements increase towards the edge of the layer meaning delay coefficient n decreases towards the edge of the layer and cylindrical lens.

FIG. 9*a* shows the top view of the first layer of a cylindrical lens where conductive elements with a circular cross section and one slit are placed in rows, and axes of the conductive elements are directed perpendicular to the layer. Distances between neighboring conductive elements are equal.

FIG. 9*b* shows the top view of the second layer of a cylindrical lens where conductive elements with a circular cross section and one slit are placed in rows and axes of the conductive elements are directed in parallel to the layer. Distances between neighboring conductive elements are equal.

FIG. 9*c* shows the top view of the third layer of a cylindrical lens where conductive elements with a circular cross section and one slit are placed in rows and axes of the conductive elements are directed in parallel to the layer and perpendicular to the rows. Distances between neighboring conductive elements are equal.

Figure 9D:
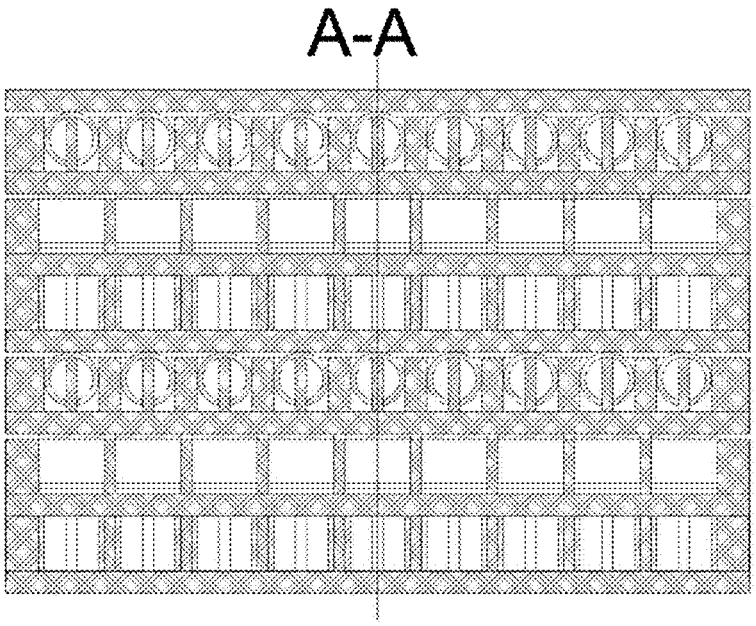
FIG. 9*d* shows the cross section of a cylindrical lens comprising six layers corresponding to FIGS. 9*a*-9*c;*

FIG. 9*d* shows the cross section of a cylindrical lens comprising six layers corresponding to FIGS. 9*a*-9*c*. The first layer and the fourth layer are equal (corresponding to FIG. 9*c*). The second layer and the fifth layers are equal (corresponding to FIG. 9*b*). The third layer and the sixth layer are equal (corresponding to FIG. 9*a*). Thus such lens is assembled of three kinds of different layers.

For other applications the conductive elements of the invention when placed in a layer could form other structures and lenses could comprise other quantities of different layers. For example, a cylindrical lens assembled of two kinds of different layers is shown in FIGS. 10*a*-10*c*.

FIG. 10*a* shows the top view of a first layer of a cylindrical lens where conductive elements are placed in radial circles about the centre of the layer which may include a central conductive element with its axis directed perpendicular to the layer. Axes of the conductive elements forming the radial circles are directed in parallel to the layer and perpendicular to a tangent to the circles. The tubes forming the second layer are shown in FIG. 10*c*. Tubes of the second layer are placed opposite of tubes forming the first layer but its axes are directed in parallel to circles excluding one tube placed in a center of the lens.

FIG. 10*c* shows the top view of a layer of a cylindrical lens where conductive elements are placed in radial circles about the centre of the layer which may include a central conductive element with its axis directed perpendicular to the layer. Axes of the conductive elements forming the radial circles are directed in parallel to the layer and parallel to a tangent to the circle they are in.

FIG. 10*b* show the cross section of a cylindrical lens comprising four layers corresponding to FIGS. 10*a* and 10*c*. The first layer and the third layer are equal (corresponding to FIG. 10*a*). The second layer and the fourth layers are equal (corresponding to FIG. 10*c*). Thus such lens is assembled of two kinds of different layers.

Another embodiment of the invention is shown in FIGS. 11*a*-11*c* where each layer of a cylindrical lens comprises a plurality of conductive elements according to the invention placed in circles and having two orthogonal orientations of their axes.

FIG. 11*a* shows the top view of the first layer. Axes of conductive elements placed in a first radial circle from the outer contour of the lens are parallel to the layer and perpendicular to a tangent to the circle. Axes of conductive elements placed in the second circle from the outer contour of the lens are directed perpendicular to the layer.

FIG. 11*c* shows the top view of the second layer. Axes of conductive elements placed in the first circle from the outer contour of the lens are directed parallel to a tangent to the circle. Axes of conductive elements placed in the second circle from the outer contour of the lens are directed perpendicular to the layer.

FIG. 11*b* shows the cross section of a cylindrical lens comprising four layers of the conductive elements where the layers correspond to FIGS. 11*a* and 11*c*. The first layer and the second layer have a different orientation of conductive elements placed in alternating circles. The first layer and the third layer are equal corresponding to FIG. 11*a*. The second layer and the fourth layers are equal corresponding to FIG. 11*c*. Thus such lens is assembled of two kinds of different layers.

Another embodiment of the present invention is shown in FIGS. 12*a* and 12*b* where each layer of a cylindrical lens comprises a plurality of conductive elements of a circular cross section with one slit, which are placed in radial circles about the central axis of the layer.

FIG. 12*a* shows the top view of the first layer of a cylindrical lens where conductive elements are placed in circles and the axes of the conductive elements are directed perpendicular to the layer. The top view of the second layer is shown in FIG. 10*a*. The top view of the third layer is shown in FIG. 10*c*.

FIG. 12*b* shows the cross section of a cylindrical lens comprising six layers of conductive elements corresponding to FIGS. 12*a*, 10*a* and 10*c*. The first layer and the fourth layer are equal corresponding to FIG. 12*a*. The second layer and the fifth layers are equal corresponding to FIG. 10*a*. The third layer and the sixth layer are equal, corresponding to FIG. 10*c*. Thus such lens is assembled of three kinds of different layers.

Another embodiment of the invention is shown in FIGS. 13*a* and 13*b* where each layer of a cylindrical lens comprises a plurality of conductive elements having a circular cross section and a slit placed in circles and having two orthogonal orientations of their axes.

FIG. 13*a* shows the top view of the first layer of a cylindrical lens where conductive elements form the structure shown in FIGS. 5*e* and 5*f*. The conductive elements are placed in circles around the central axis of the layer and each circle contains conductive elements with axes directed perpendicular to the layer, and conductive elements with axes directed in parallel to the layer and parallel to a tangent to the circle.

FIG. 13*b* shows the cross section of a cylindrical lens comprising four layers of the conductive elements. Conductive elements of the first layer with axes directed parallel to the layer are parallel to a tangent to the circle they are in. Conductive elements of the second layer with axes directed in parallel to the layer are directed perpendicular to a tangent to the circle they are in. The first layer and the third layer are equal. The second layer and the fourth layers are equal. Thus such lens is assembled of two kinds of different layers.

Another embodiment of the invention is shown in FIGS. 14*a* and 14*b* where a cylindrical lens made of the provided lightweight artificial dielectric material of the invention comprises a rod made of dielectric material placed in the middle of the cylindrical lens. Such rod increases delay coefficient n in the middle of the cylindrical lens and provides mechanical support for the lightweight dielectric sheets forming the lens. Layers of the cylindrical lens shown in FIGS. 14*a* and 14*b* have the same structure as layers of the cylindrical lens shown in FIGS. 13*a* and 13*b*.

Another embodiment of the invention is shown in FIGS. 15*a* and 15*b* where each layer of a cylindrical lens comprises a plurality of conductive elements placed in circles and having three orthogonal orientations of their axes.

FIG. 15*a* shows the top view of a layer. Axes of conductive elements placed in the first circle from the outer contour of the lens are directed in parallel to the layer and parallel to a tangent to the circle. Axes of conductive elements placed in the second circle from the outer contour of the lens are directed in parallel to the layer and perpendicular to a tangent to the circle. Axes of conductive elements placed in the third circle from the outer contour of the lens are directed perpendicular to the layer. Axes of conductive elements forming the first, fourth and seventh circles are directed in parallel to tangents to their respective circles. Axes of conductive elements forming the second, fifth and eight circles are directed perpendicular to tangents to their respective circles. Axes of conductive elements forming the third, sixth and ninth circles are directed perpendicular to the layer. These conductive elements may be shorter than other conductive elements forming the layer.

FIG. 15*b* shows the cross section of a cylindrical lens containing four equal layers shown in FIG. 15*a*. Thus such lens is assembled of layers of one kind only.

The described above cylindrical lenses contain conductive elements of substantially tubular shape, comprising a slit along their length so as to provide a gap between two longitudinal edges and separate the tube. However, other shapes of conductive elements, such as those shown in FIGS. 7*a*-7*d* can be used in as the conductive elements. These conductive elements may also contain slots such as those shown in FIGS. 4*b*, 4*d*, 4*e* and 4*f*, and can be used in the artificial dielectric material layers and lenses of the invention.

Focusing lenses which could be created from the provided artificial dielectric material are not limited to those described above and those shown in the figures. Layers of focusing lenses could be formed in other structures and orientations also.

For example the structures shown in FIGS. 5*g* and 5*h* include rows of conductive elements of the same type with the axes of these conductive elements directed in three different orthogonal directions. If the conductive elements forming one layer of a cylindrical lens are placed in circles each circle may contain conductive elements with axes having three orthogonal directions. Such lenses could be assembled of layers of one kind only.

Conductive elements forming a layer could be the same or may have different shapes or dimensions, such as including conductive elements of substantially circular and hexagonal cross-sections in a single layer. Equally, lenses may be comprised of multiple layers, each layer including conductive elements of only one type. For example, a layer of conductive elements having a substantially circular cross-section, such as shown in FIGS. 8 and 9*a*, followed by a layer of conductive elements of substantially circular and hexagonal, square or octagonal cross-section, or any combination of such single type of conductive element layers.

Distances between the conductive elements could be equal and form a structure providing consistent delay coefficient n along a layer. Distances between the conductive elements could be unequal and form several areas providing different delay coefficients n along a layer.

The provided artificial dielectric material containing the conductive elements having three orthogonal directions of axes is particularly suitable for manufacturing spherical Luneburg lenses which have to be made of isotropic dielectric material having the same delay coefficient n for any direction and polarization of electromagnetic wave. By contrast, existing materials such as those made of layers shown in FIGS. 5-7 of NZ 752904 are formed by tubes having axes directed perpendicular to the layer. As delay coefficient n depends on the angle between the direction of electromagnetic wave crossing the material and the axes of tubes such artificial dielectric material doesn't suit for many applications requiring isotropic dielectric material providing the same value of delay coefficient n for any direction and polarization of electromagnetic wave.

The invention also relates to a method for manufacturing artificial dielectric materials which may be in turn used in the production of lenses comprised of multiple layers of the artificial dielectric materials. The method involves placing conductive elements according to the invention in holes in a plurality of sheets of a dielectric material, and stacking said sheets together, wherein the sheets of the dielectric material containing the conductive elements are separated by sheets of the dielectric material without the conductive elements, and wherein axes of the conductive elements are orientated along at least two different directions. As an alternative, the sheets not containing the dielectric material may be omitted and the sheets containing the conductive element may have holes which do not pass through the thickness of the sheet. In such manner, the conductive elements of each layer may be kept separated as is desired.

The conductive elements may be placed into pre-existing holes in the sheets of the dielectric material. Further, the manufacturing process may require that the conductive elements are bent into the required shape at the time of being placed into pre-existing holes in the sheets of the dielectric material. Alternatively, conductive elements which have been pre-formed into their required shape may be placed into the holes at the time of assembly.

The invention also relates to a method of focusing a radio wave using a focusing lens according to the invention. Such lens may be preferably cylindrical or spherical or may have another geometry. Use of such a focusing lens comprising the artificial dielectric material and conductive elements according to the invention allows focusing of radio waves with less dependence on direction and polarization of electromagnetic waves.

While some preferred aspects of the invention have been described by way of example, it should be appreciated that modifications and/or improvements can occur without departing from the scope of the invention as claimed in this specification.

The terms comprise, comprises, comprising or comprised, if and when used herein, should be interpreted non-exclusively, that is, as conveying "consisting of, or including".

It is to be understood that, if any prior art publication is referred to herein, such reference does not constitute an admission that the publication forms a part of the common general knowledge in the art, in New Zealand or any other country.

The invention claimed is:

1. An artificial dielectric material comprising a plurality of layered sheets of a foam polymer dielectric material and a plurality of conductive elements disposed in holes made in the sheets of the dielectric material, wherein each conductive element is substantially tubular and comprises a slit along its length so as to provide a gap between two longitudinal edges.

2. The artificial dielectric material according to claim 1, wherein each conductive element comprises a conductive material bent into a substantially tubular shape.

3. The artificial dielectric material according to claim 1, wherein each conductive element comprises a conductive material attached to a dielectric substrate.

4. The artificial dielectric material according to claim 1, wherein the holes in the dielectric material contain projections adapted to be disposed in the slit separating the longitudinal edges of the conductive elements.

5. The artificial dielectric material according to claims 1 wherein the conductive element includes slots.

6. The artificial dielectric material according to claim 5, wherein the slots are disposed in parallel to the longitudinal edges of the conductive element.

7. The artificial dielectric material according to claim 1 wherein axes of the conductive elements are orientated in at least two different directions.

8. The artificial dielectric material according to claim 7, wherein the at least two different directions are orthogonal directions.

9. The artificial dielectric material according to claim 1, wherein the conductive elements have at least two different shapes.

10. The artificial dielectric material according to claim 1, wherein the conductive elements have a cross section in a shape of a circle and/or a polygon.

11. The artificial dielectric material according to claim 1, wherein the foam polymer is made of a material selected from polyethylene, polystyrene, polypropylene, polyurethane, silicon and polytetrafluoroethylene.

12. The artificial dielectric material according to claim 1, wherein the conductive elements disposed in one layer form a square lattice providing equal distances between neighboring elements disposed in the same row or same column.

13. The artificial dielectric material according to claim 1, wherein the conductive elements disposed in one layer form a honeycomb lattice providing equal distances between any neighboring conductive elements.

14. The artificial dielectric material according to claim 1, wherein axes of the conductive elements disposed in one layer are directed in the same direction.

15. The artificial dielectric material according to claim 14, wherein axes of the conductive elements disposed in one layer are directed perpendicular to the layer.

16. The artificial dielectric material according to claim 14, wherein axes of the conductive elements disposed in one layer are directed parallel to the layer.

17. The artificial dielectric material according to claim 1, wherein axes of some conductive elements disposed in one layer are directed perpendicular to the layer and axes of other conductive elements in that layer are directed in parallel to the layer.

18. The artificial dielectric material according to claim 17, wherein axes of the conductive elements directed in parallel to the layer are directed in different directions.

19. A cylindrical focusing lens comprising the artificial dielectric material according to claim 1.

20. The cylindrical focusing lens according to claim 19, wherein the conductive elements of each layer form a sunflower lattice.

21. The cylindrical focusing lens according to claim 19, wherein the conductive elements of each layer are placed radially in circles.

22. The cylindrical focusing lens according to claim 19, comprising layers with the conductive elements having axes directed only perpendicular to the layer and layers containing conductive elements having axes directed only in parallel to the layer.

23. The cylindrical focusing lens according to claim 22, wherein the axes of the conductive elements of a first layer containing the conductive elements with axes directed only in parallel to the layer are directed perpendicular to axes of the conductive elements of a second layer containing conductive elements with axes directed in parallel to the layer.

24. The cylindrical focusing lens according to claim 19, wherein each layer contains conductive elements with axes directed perpendicular to the layer and conductive elements with axes directed in parallel to the layer.

25. The cylindrical focusing lens according to claim 19 comprising at least two types of layers, wherein a first layer comprises conductive elements with axes directed parallel to the layer, and a second layer which comprises conductive elements with axes directed perpendicular to the axes of the conductive elements of the first layer.

26. The cylindrical focusing lens according to claim 19, wherein each layer contains circles of conductive elements having axes directed perpendicular to the layer and circles of conductive elements having axes directed in parallel to the layer.

27. The cylindrical focusing lens according to claim 26, wherein at least one circle contains conductive elements having axes directed in parallel to the layer and in parallel to the circle.

28. The cylindrical focusing lens according to claim 26, wherein at least one circle contains conductive elements having axes directed in parallel to the layer and perpendicular to the circle.

29. The cylindrical focusing lens according to claim 19, wherein a dielectric rod is placed along longitudinal axis of the cylindrical focusing lens.

30. A spherical focusing lens comprising the artificial dielectric material according to claim 1.

31. A method for manufacturing the artificial dielectric material according to claim 1, comprising placing conductive elements in a plurality of sheets of a foam polymer dielectric material, and stacking said sheets together, wherein the sheets of the dielectric material containing the conductive elements are separated by sheets of the dielectric material without the conductive elements, and wherein axes of the conductive elements are orientated in at least two different directions.

32. The method according to claim 31, wherein the conductive elements are placed into pre-existing holes in the sheets of the dielectric material.

33. The method according to claim 31, wherein the conductive elements are flat and are bent into the required shape at the time of being placed into pre-existing holes in the sheets of the dielectric material.

* * * * *